US006574841B1

(12) United States Patent
Vosahlik et al.

(10) Patent No.: US 6,574,841 B1
(45) Date of Patent: Jun. 10, 2003

(54) LIGHTWEIGHT BURIAL CASKET

(75) Inventors: Garry W. Vosahlik, Batesville, IN (US); Wilbur Schebler, Batesville, IN (US); Troy Acton, St. Paul, IN (US); Richard A. Colangelo, Indianapolis, IN (US); Charles F. Winburn, Batesville, IN (US)

(73) Assignee: Batesville Services, Inc., Batesville, IN (US)

( * ) Notice: Subject to any disclaimer, the term of this patent is extended or adjusted under 35 U.S.C. 154(b) by 0 days.

(21) Appl. No.: 09/430,866

(22) Filed: Nov. 1, 1999

Related U.S. Application Data

(62) Division of application No. 09/018,500, filed on Feb. 4, 1998, now Pat. No. 5,974,640.

(51) Int. Cl.[7] ..... A61G 17/00
(52) U.S. Cl. ..... 27/16; 27/14
(58) Field of Search ..... 27/2, 14, 16, 4, 27/19; D99/1; 220/252, 334; 40/650, 738

(56) References Cited

U.S. PATENT DOCUMENTS

| | | | | |
|---|---|---|---|---|
| 678,348 | A | | 7/1901 | Nichols |
| 768,481 | A | | 8/1904 | Post |
| 1,234,180 | A | | 7/1917 | Kersten |
| 1,507,957 | A | | 9/1924 | Edwards |
| 1,892,228 | A | * | 12/1932 | Yochheim ..... 27/19 |
| 2,338,035 | A | | 12/1943 | Gerold |
| 2,392,298 | A | | 1/1946 | Thommen |
| 2,448,923 | A | | 9/1948 | Skolnik |
| 2,494,473 | A | | 1/1950 | Dowling |
| 3,164,880 | A | | 1/1965 | Hotchkiss |
| 3,207,357 | A | * | 9/1965 | Schmitt ..... 220/62 |
| 3,220,080 | A | | 11/1965 | Connelly |
| 3,406,229 | A | | 10/1968 | Cenegy |
| 3,490,114 | A | | 1/1970 | Connelly et al. |
| 3,574,906 | A | | 4/1971 | Rittenhouse |
| 3,729,786 | A | | 5/1973 | Walding |
| 3,879,818 | A | | 4/1975 | Rowland |

(List continued on next page.)

FOREIGN PATENT DOCUMENTS

| | | |
|---|---|---|
| GB | 1145571 | 3/1969 |
| GB | 1535188 | 12/1978 |
| GB | 2064485 | 6/1981 |
| GB | 2114498 | 8/1983 |
| JP | 54-110071 | 8/1979 |
| JP | 62-11667-4 | 7/1987 |
| JP | 63-88322 | 6/1988 |
| JP | 2-88629 | 7/1990 |
| JP | 3-198852 | 8/1991 |
| JP | 3-88517 | 9/1991 |
| JP | 4-3729 | 1/1992 |
| JP | 4-3730 | 1/1992 |
| JP | 4-22934 | 2/1992 |
| JP | 4-65534 | 6/1992 |

*Primary Examiner*—Brian K. Green
(74) *Attorney, Agent, or Firm*—Wood, Herron & Evans, L.L.P.

(57) ABSTRACT

A lid for a casket includes a cover including longitudinally spaced-apart first and second end edges, transversely spaced-apart first and second side edges, and a dome extending between the first and second side edges and between the first and second end edges, and an end cap including an end panel and a rim appended to the end panel. The end cap is coupled to the cover adjacent to the first end edge. The rim extends from the end panel to cover a portion of the cover adjacent to the first end edge.

28 Claims, 20 Drawing Sheets

U.S. PATENT DOCUMENTS 3,969,798 A 7/1976 Sahlin
4,044,435 A 8/1977 Acton
4,123,831 A 11/1978 Covington
4,151,630 A 5/1979 Havey
4,156,956 A 6/1979 Partridge et al.
4,170,054 A 10/1979 Ruffner et al.
4,176,431 A 12/1979 Havey, III
4,209,880 A 7/1980 Lidholm
4,261,083 A 4/1981 Darby et al.
4,517,713 A 5/1985 Swallert
4,697,316 A 10/1987 Semon
4,730,370 A 3/1988 Elder
4,773,134 A 9/1988 Kay
4,788,757 A 12/1988 Bethune et al.
4,800,631 A * 1/1989 Pellmann ..... 27/2 X
4,824,513 A 4/1989 Dodds
4,891,869 A 1/1990 Nutting
4,902,365 A 2/1990 Westlake, Sr.
4,930,197 A 6/1990 McClive
4,944,076 A 7/1990 Kay et al.
4,967,455 A 11/1990 Elder
4,990,391 A 2/1991 Veta et al.
5,035,032 A 7/1991 Nutting
5,041,323 A 8/1991 Rose et al.
5,106,668 A 4/1992 Turner et al.
5,111,559 A 5/1992 Mohr et al.
5,115,607 A * 5/1992 Pirozzoli et al. ..... 52/134
5,231,741 A 8/1993 Maguire
5,245,733 A 9/1993 Goria
5,307,545 A 5/1994 Stoltz
5,353,484 A 10/1994 Woedl et al.
5,454,141 A 10/1995 Ozbun et al.
5,580,415 A 12/1996 Diekwisch
5,660,380 A 8/1997 Reis et al.
5,667,128 A 9/1997 Rohde et al.
5,685,937 A 11/1997 Tambussi
5,770,291 A 6/1998 Tambussi
5,771,550 A 6/1998 Laphan et al.

* cited by examiner

FIG. 3
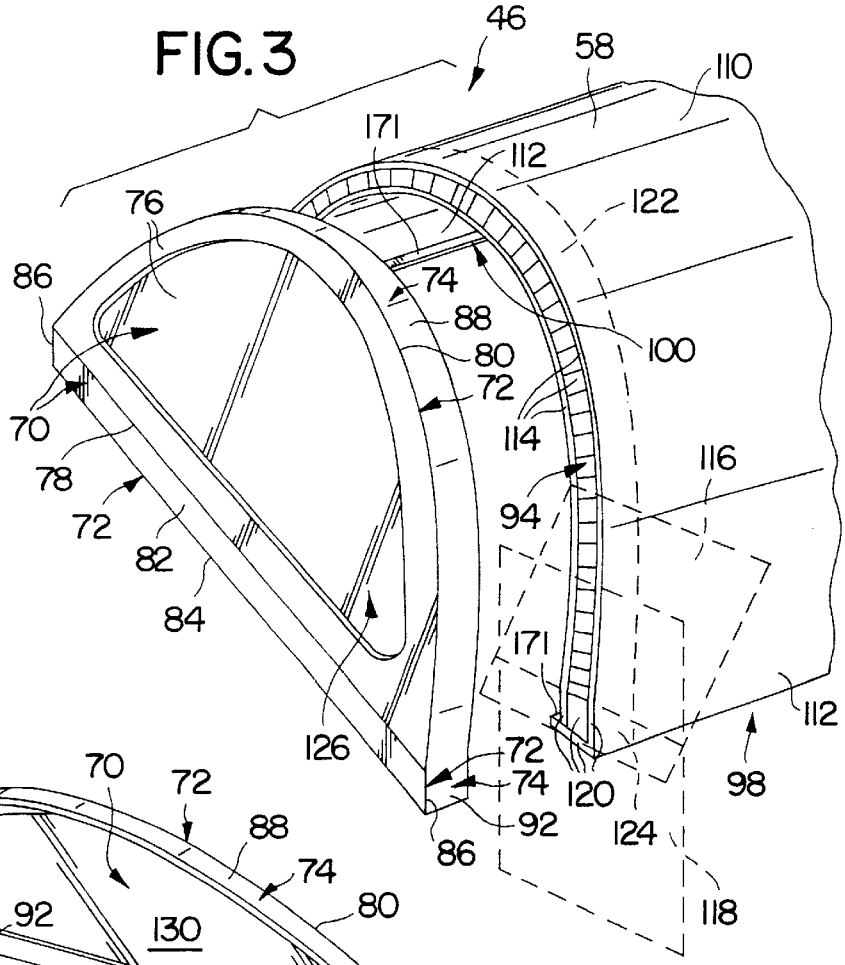
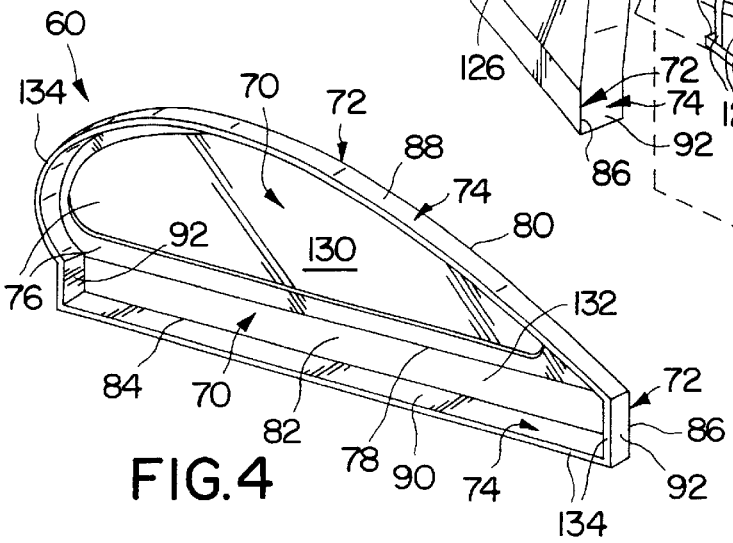
FIG. 4
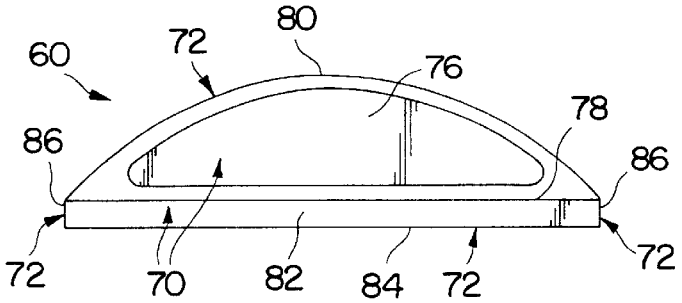
FIG. 5
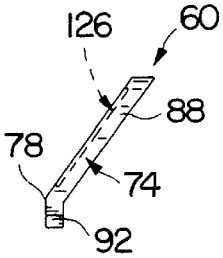
FIG. 6

LIGHTWEIGHT BURIAL CASKET

This application is a divisional of U.S. application Ser. No. 09/018,500, filed Feb. 4, 1998, now U.S. Pat. No. 5,974,640.

FIELD OF THE INVENTION

The present invention relates to a casket and particularly, to a lightweight burial casket having a lid and a casket shell made partially of a paperboard or fiberboard material. More particularly, the present invention relates to the features of the lid and casket shell of the casket, the methods for making the lid and the casket shell, and the apparatus used to make the lid and casket shell.

BACKGROUND OF THE INVENTION

Caskets made of a paperboard material such as corrugated fiberboard and honeycomb core material are known in the art. Such caskets are generally less expensive and lighter in weight than conventional caskets made of wood or metal. While it is desirable for caskets made of paperboard material to be produced as inexpensively as possible, it is also desirable for such caskets to have features that are usually included in the more expensive, wood or metal caskets. For example, some wood or metal caskets include tilting mechanisms for tilting a mattress relative to a casket shell of the casket to enhance the position at which a deceased person is displayed in the casket.

Conventional casket lids have a relatively complex shape, sometimes requiring a number of separate pieces to be attached together after a considerable number of machining operations are performed on the separate pieces. Casket lids made of bendable and foldable sheets of material such as paperboard and metal typically will have a number of cuts or score lines made in the sheets of material to allow folding of the sheets into the desired casket lid shape. The complex shape of casket lids results in high production costs for casket lids. Therefore, a casket lid made of components that are assembled by a manufacturing method resulting in reduced casket lid production costs would be welcomed in the art.

Conventional caskets typically have either a single lid that extends over the full length of the interior region of the casket shell or a pair of lid halves that each extend over half of the interior region of the casket shell. One way of making casket lids from bendable or foldable elements is to place the elements in a fixture or die having a surface that matches the desired shaped of the casket lid. Such fixtures are often expensive and separate fixtures for full-length and half-length casket lids are generally required. A single casket lid production fixture capable of producing fulllength casket lids and lid halves would be welcomed in the art as well.

SUMMARY OF THE INVENTION

According to the present invention, a lid for a casket includes a cover having longitudinally spaced-apart first and second end edges and transversely spaced-apart first and second side edges. The cover includes a dome extending between the first and second side edges and between the first and second end edges. The lid further includes an end cap having an end panel and a rim appended to the end panel. The end cap is coupled to the cover adjacent to the first end edge and the rim extends from the end panel to cover a portion of the cover adjacent to the first end edge.

In preferred embodiments, the lid includes a second end cap including a second end panel and a second rim appended to the second end panel. The second end cap is coupled to the cover adjacent to the second end edge. The second rim extends from the second end panel to cover a portion of the cover adjacent to the second end edge. Each of the first and second end caps are made from a plastics material so that the first and second end caps are each single contiguous pieces. An upper portion of the rims of the end caps are configured to abut the cover of the lid and are formed to have contours that match the contour of the cover. If the cover portion of the lid is for a full-length lid that covers the entire interior region of a casket shell of the casket, the first and second end panels each include a beveled wall which is inclined with respect to transverse ends of the casket shell. If the cover portion of the lid is for a half-length lid that covers about half of the interior region of the casket shell, the first end cap includes a beveled wall which is inclined with respect to the transverse ends of the casket shell and the second end panel is substantially vertical and crescent-shaped.

Also according to the present invention, a fixture used during construction of a casket lid from casket lid elements includes a frame and a first press coupled to the frame. The first press includes a first base configured to support a first portion of the casket lid elements and a first press head coupled to the first base for movement between a press position pressing the first portion of the casket lid elements against the first base to enhance the uniformity with which films of adhesive between the first portion of the casket lid elements adhere the first portion of the casket lid elements together and a release position spaced apart from the first portion of the casket lid elements.

The fixture further includes a second press coupled to the frame for movement relative thereto and relative to the first press. The second press includes a movable base configured to support a second portion of the casket lid elements and a second press head coupled to the movable base for movement between a press position pressing the second portion of the casket lid elements against the movable base to enhance the uniformity with which films of adhesive between the second portion of the casket lid elements adhere the second portion of the casket lid elements together and a release position spaced apart from the second portion of the casket lid elements. The second press is movable relative to the frame between a first position spaced apart from the first press allowing separate first and second casket lid halves of the casket lid to be constructed on the respective first and second presses and a second position adjacent to the first press allowing the casket lid to be constructed as a one piece, full-length unit.

In preferred embodiments, the first and second press heads are each mounted to respective first and second trusses. The first and second trusses are each mounted to the respective bases for pivoting movement. The fixture further includes first and second actuators that are coupled to the trusses and that are actuatable to move the press heads from respective press positions in which the casket lid elements are pressed together with a first amount of force to respective heavy-press positions in which the casket lid elements are pressed together with a second amount of force greater than the first amount of force. In addition, the fixture includes first and second latches for locking the trusses in the lowered positions having the press heads pressing the casket lid elements against the respective bases. The fixture also includes a set of clamps that clamp the first and second end caps against the casket lid elements so that adhesive applied to the casket lid elements and applied to the end caps adheres the end cap to the casket lid elements in a proper orientation.

According to another aspect of the present invention, a casket includes a casket shell having longitudinally spaced-apart first and second end walls, transversely spaced-apart side walls, and a bottom wall cooperating with the side and end walls to determine an interior region of the casket. A body support is positioned to lie in the interior region of the casket shell and is configured to support the body of a deceased. The body support includes longitudinally spaced-apart first and second ends. The casket also includes a tilting mechanism coupled to the first end of the body support. The tilting mechanism is operable to move the first end in the interior region of the casket shell. The casket shell additionally includes an end insert panel positioned to lie in the interior region of the casket shell and fastened to the first end wall. The tilting mechanism is coupled to the end insert panel.

In preferred embodiments, the casket shell is made by adhering paperboard casket shell elements together to form a casket shell blank and then folding the casket shell blank to form a box of the casket shell. The end insert panel is made of a material stronger than paperboard and is placed in the interior region of the casket shell adjacent to transverse end flaps of the casket shell blank which comprise a transverse end wall of the box. The end flaps are fastened to the end panel to secure the casket shell blank in the folded configuration to form the casket shell.

Additional features and advantages of the present invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which:

FIG. 3 is a perspective view of a first end cap of the head end lid half exploded away from a first end edge of a cover of the head end lid half showing an end panel of the first end cap and a perimetral rim extending away from the end panel, the perimetral rim being configured to cover a portion of the cover adjacent to the first end edge;

FIG. 4 is a perspective view of the first end cap of FIG. 3 showing an interior surface of the end panel of the first end cap and the perimetral rim having a rim edge spaced apart from the interior surface;

FIG. 5 is an end elevation view of the first end cap of FIG. 4 showing an upper perimeter portion of a beveled wall of the end panel having an arcuate shape and a bottom perimeter portion of a vertical wall of the end panel being straight and extending horizontally;

FIG. 6 is a side elevation view of the first end cap of FIG. 5 showing the perimetral rim of the first end cap extending longitudinally away from the beveled wall and extending longitudinally away from the vertical wall by a substantially uniform amount;

FIG. 12 is an exploded perspective view of a first fixture used in the construction of the lid halves showing an outer surface element and a pair of side rails of one of the lid halves positioned to lie above a table of the first fixture;

FIG. 13 is a perspective view of the first fixture of FIG. 12 showing a set of clamp arms each moved to a vertical position clamping the side rails against a central cover portion of the outer surface element and against longitudinal edge flaps of the outer surface element to enhance the uniformity with which adhesive between the side rails and outer surface element adheres the side rails to the outer surface element;

FIG. 14 is an enlarged perspective view of one of the clamp arms of FIG. 13 showing the clamp arm having a portion abutting a top surface of the side rail and a portion abutting a side surface of the side rail;

FIG. 15 is an enlarged perspective view of the clamp arm of FIG. 14 showing the clamp arm having a pair of curved cam surfaces formed in a bottom end thereof;

FIG. 16 is an exploded perspective view of a first lid-brace attachment fixture used in the construction of the lid halves showing an end cap similar to the end cap of FIG. 3 positioned to lie above a set of positioners attached to a table of the first lid-brace attachment fixture, a portion of the end cap being broken away to show further detail of one of the positioners, a clamp assembly coupled to the table and moved to a releasing position, a hinged lid-brace sample coupled to the table, a hinged lid brace and a brace block above the end cap, and a spacer template positioned between the brace block and the end cap;

FIG. 17 is an exploded perspective view of a second lid-brace attachment fixture used in the construction of the lid halves showing the end cap of FIG. 3 positioned on a table of the second lid-brace attachment fixture by a set of positioners attached to the table, a clamp assembly coupled to the table and moved to a clamping position engaging a brace block, a hinged lid-brace sample coupled to the table, and a hinged lid-brace positioned to lie above a cut-out formed in a clamp pad of the clamp;

FIG. 18 is a perspective view of a lid-press fixture used in the construction of the lid halves showing a first lid press mounted on an underlying frame of the lid-press fixture, a second lid press supported on the frame by a set of rollers (in phantom), the second lid-press being in a first position spaced apart from the first lid press, a first outer surface element with side rails attached thereto exploded away from a concave surface of the first lid press, and a second outer surface element with side rails attached thereto exploded away from a concave surface of the second lid press;

FIG. 19 is a perspective view of the lid-press fixture of FIG. 18 after the first and second outer surface elements are placed on the respective concave surfaces showing a first honeycomb core and a first inner surface element exploded away from the first outer surface element and showing a second honeycomb core and a second inner surface element exploded away from the second outer surface element;

FIG. 20 is a perspective view of the lid-press fixture of FIG. 19 after the first and second honeycomb cores and after the first and second inner surface elements are placed on the respective first and second outer surface elements to form respective covers of the casket lid halves showing end caps clamped against opposing ends of respective cover portions and showing a light blocker strip exploded away from one of the end caps;

FIG. 21 is a perspective view of the lid-press fixture of FIG. 20 showing first and second press heads of the respective first and second lid presses moved from a raised position, shown in FIGS. 18–20, to a lowered position so that convex surfaces of the first and second press heads are moved into contact with the first and second inner surface elements to compress the inner surface elements, the honeycomb core elements, and the outer surface elements together to enhance the uniformity with which adhesive applied to the inner surface elements, the honeycomb core elements, and the outer surface elements adheres the inner surface elements, the honeycomb core elements, and the outer surface elements together;

FIG. 22 is a top plan view of the lid-press fixture of FIG. 21 showing a pair of first anti-warping struts coupled to the first lid press and arranged in a first position in which curved ends of the first anti-warping struts are spaced apart from the first inner surface element of the respective lid half and showing a pair of second anti-warping struts (in phantom) coupled to the second lid press and arranged in a second position in which curved ends of the second anti-warping struts engage the second inner surface element of the respective lid half to prevent warping of the second inner surface element, the second honeycomb core element, and the second outer surface element as the second press head applies pressure to the second inner surface element, the second honeycomb core element, and the second outer surface element;

FIG. 23 is a sectional view, taken along line 23—23 of FIG. 22, showing a first actuator coupled to a frame member of a first truss that supports the first press head, a second actuator coupled to a frame member of a second truss that supports the second press head, the first actuator in an unactuated position having the first press head pressing against the respective casket lid elements with a first amount of force, and the second actuator in an actuated position having the second press head pressing against the respective casket lid elements with an increased amount of force;

FIG. 24 is a diagrammatic top plan view of first and second pairs of parallel hinge-and-latch templates of the lid-press fixture showing a piece of hinge hardware arranged for insertion into one of a plurality of hinge cut-outs formed in the templates and showing a piece of latch hardware arranged for insertion into one of a plurality of latch cut-outs formed in the templates;

FIG. 29 is a perspective view of a casket blank-forming fixture showing a table of the blank-forming fixture having an upwardly facing table surface, a membrane structure of the blank-forming fixture supported above the table, a pair of venturi pumps of the membrane structure coupled by a plurality of suction hoses to respective apertures formed in a flexible membrane of the membrane structure, an exploded set of casket blank elements arranged between the table and the membrane structure, a pair of positioning templates adjacent to opposite ends of a bottom casket blank element, and the membrane structure being moveable in the direction of the large double arrow to compress the casket blank elements between the table surface and the membrane of the membrane structure;

FIG. 30 is a sectional view, taken along line 30—30 of FIG. 29, after the membrane structure is locked to the table by a pair of latches located at opposite ends of the table;

FIG. 31 is a perspective view of the casket shell of FIG. 25 after the casket shell elements have been adhered together showing the casket shell elements partially folded to form a box of the casket shell and showing a pair of end insert panels arranged for insertion into the interior region of the box;

FIG. 32 is a sectional view of a drill-guide jig used during the creation of dowel holes in frame members that form upper and lower molding frames which attach to the box of the casket shell;

FIG. 33 is front elevation view of the drill-guide jig of FIG. 32 showing a lower frame member (in phantom) of rectangular cross section on a left side of a vertically extending center plate of the drill-guide jig and an upper frame member (in phantom) of L-shaped cross section on a right side of the center plate;

FIG. 34 is a perspective view of a miter dowel that is received in the dowel holes of the frame members to secure the frame members together to form the upper and lower molding frames which attach to the box of the casket shell;

FIG. 35 is a perspective view of a fixture table used to clamp the frame members together to form the upper and lower molding frames showing the frame members of the lower molding frame exploded away from the fixture table, the box of the casket shell above the lower frame members, and the upper molding frame above the casket shell;

DETAILED DESCRIPTION OF THE DRAWINGS

Figure 1:
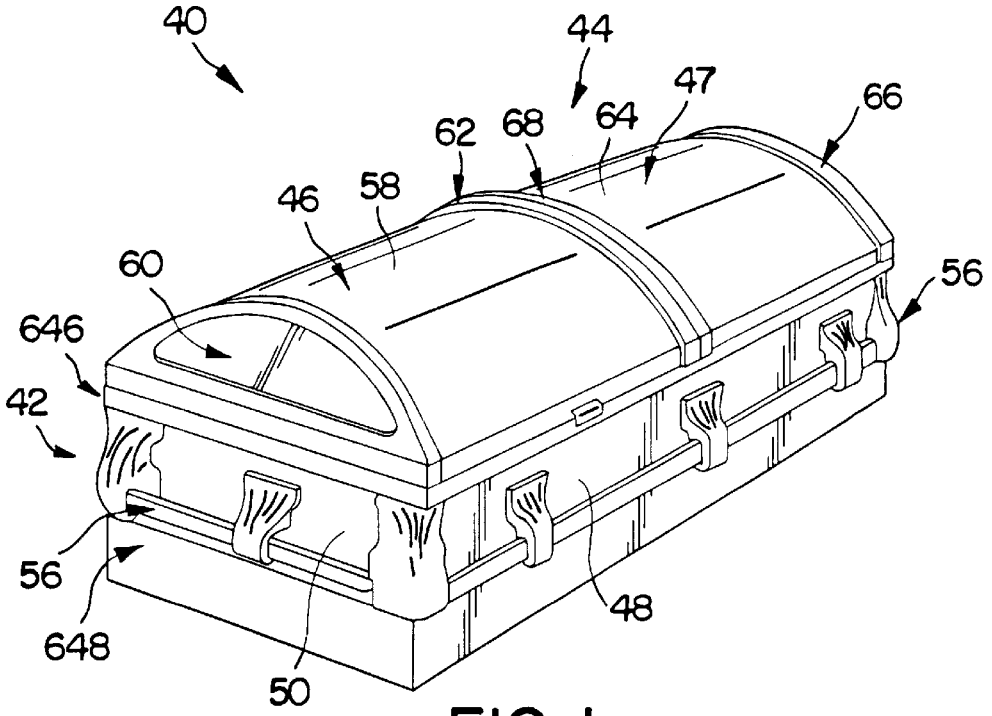
FIG. 1 is a perspective view of a lightweight burial casket in accordance with the present invention showing a head end lid half and a foot end lid half each in a closed position on a casket shell of the casket.

A casket 40 in accordance with the present invention includes a casket shell 42 and a lid 44 having a head end lid half 46 and a foot end lid half 47 as shown in FIG. 1. Casket shell 42 includes a pair of transversely spaced-apart, longitudinally extending side walls 48 and a pair of longitudinally spaced-apart, transversely extending end walls 50. Casket shell 42 also includes a bottom wall 52, shown in FIGS. 31 and 36, that extends between side walls 48 and end walls 50. Casket shell 42 includes an interior region 54 above bottom wall 52 and surrounded by side walls 48 and end walls 50 as shown, for example, in FIG. 2. Casket 40 includes handle hardware 56 attached to side and end walls 48, 50 of casket shell 42. Handle hardware 56 is grasped to carry casket 40.

Figure 2:
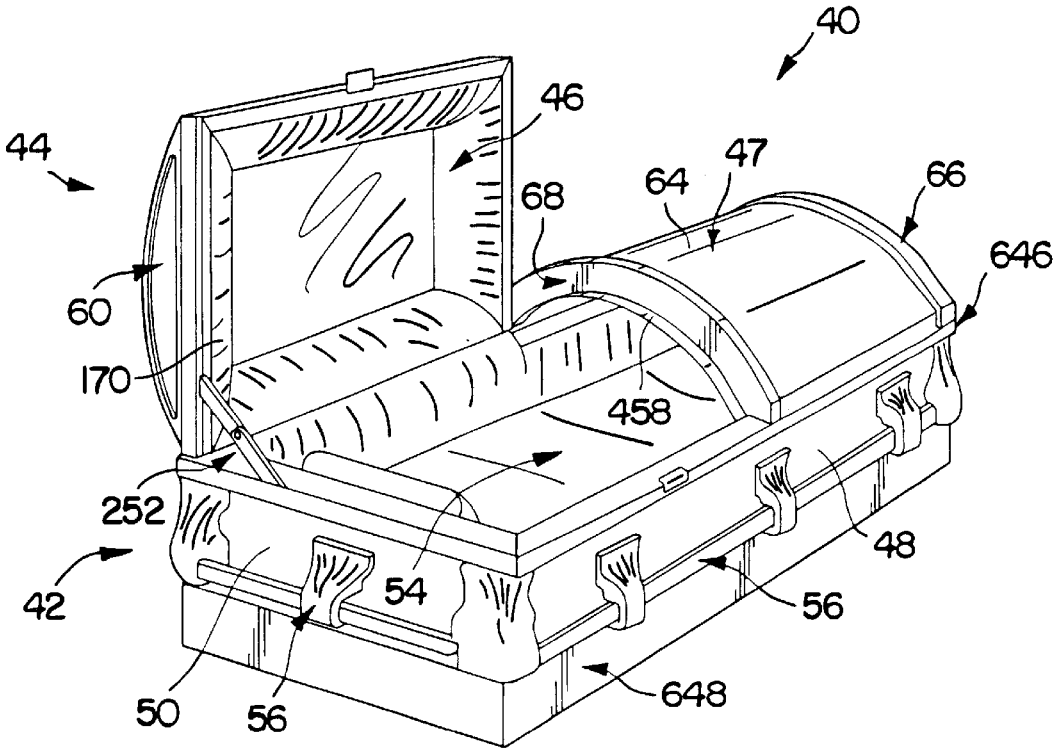
FIG. 2 is a perspective view of the casket of FIG. 1 showing the head end lid half moved to an opened position to expose an interior region of the casket shell.

Each lid half 46, 47 is coupled to casket shell 42 for pivoting movement between a closed position in which a respective portion of interior region 54 is covered by the overlying lid half 46, 47, as shown in FIG. 1, and an opened position in which the respective portion of interior region 54 is uncovered and accessible, as shown in FIG. 2 with reference to head end lid half 46. Head end lid half 46 includes a cover 58, a first end cap 60 coupled to one end of cover 58, and a second end cap 62 coupled to an opposite end of cover 58. Likewise, foot end lid half 47 includes a cover 64, a third end cap 66 attached to one end of cover 64, and a fourth end cap 68 attached to an opposite end of cover 64.

In preferred embodiments, end caps 60, 62, 66, 68 are vacuum formed out of a plastics material and are each single contiguous pieces. However, it is within the scope of the invention as presently perceived for end caps 60, 62, 66, 68 to be injection molded or made by other manufacturing processes. First and third end caps 60, 66 are vacuum formed using the same mold so as to have substantially identical shapes. Thus, the description below of first end cap 60, shown best in FIGS. 3–6, and the manner in which first end cap mounts to cover 58 applies as well to third end cap 66 and the manner in which third end cap 66 mounts to cover 64. In addition, second and fourth end caps 62, 68 are molded in the same mold so as to have substantially identical shapes. Thus, the description below of second end cap 62, shown best in FIGS. 7–10, and the manner in which second end cap 62 mounts to cover 58 applies as well to fourth end cap 68 and the manner in which fourth end cap 68 mounts to cover 64.

First end cap 60 includes an end panel 70 having a perimeter 72 and a perimetral rim 74 extending away from perimeter 72 of end panel 70 as shown in FIGS. 3 and 4. End panel 70 includes a beveled wall 76 with a straight lower perimeter portion 78 and an arcuate upper perimeter portion 80. End panel 70 also includes a vertical wall 82 appended to straight lower perimeter portion 78 of beveled wall 76. Vertical wall 82 includes a straight lower perimeter portion 84 and a pair of side perimeter portions 86. Thus, perimeter 72 includes perimeter portions 80, 84, 86 and vertical wall 82 is appended to beveled wall 76 at perimeter portion 78.

Perimetral rim 74 includes an arcuate upper band 88 appended to and extending longitudinally from arcuate perimeter portion 80, a lower band 90 appended to and extending longitudinally from lower perimeter portion 84 as shown in FIG. 4, and a pair of side bands 92 appended to and extending longitudinally from respective side perimeter portions 86. In addition, side bands 92 integrally interconnect arcuate upper band 88 with lower band 90. Thus, perimetral rim 74 includes bands 88, 90, 92 that form a contiguous band around the perimeter 72 of end panel 70 such that perimetral rim 74 and perimeter 72 have substantially the same shape.

Beveled wall 76 includes an interior surface 130 and vertical wall 82 includes an interior surface 132 as shown in FIG. 4. Perimetral rim 74 includes a rim edge 134 that is spaced apart from interior surfaces 130, 132 by a longitudinal distance that is substantially uniform about perimeter 72. In addition, the material thickness of bands 88, 90, 92 of perimetral rim 74 are substantially uniform between end panel 70 and rim edge 134. In preferred embodiments, the material thickness of perimetral rim 74 is substantially equivalent to the material thickness of end panel 70. However, there may be a small amount of thickness variation in perimetral rim 74 and in end panel 70 due to material thickness variations that inherently occur when parts are made by a vaccuum forming operation.

Figure 7:
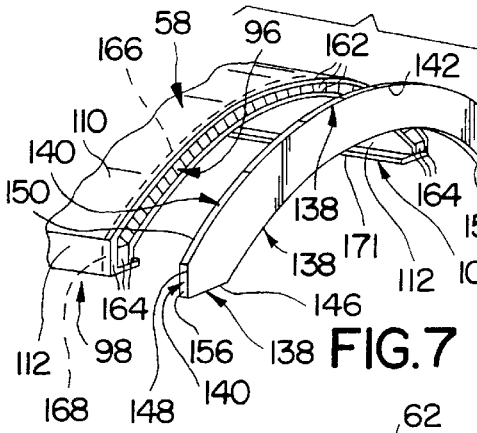
FIG. 7 is a perspective view of a second end cap of the head end lid half exploded away from a second end edge of the cover of the head end lid half showing an end panel of the second end cap and a perimetral rim of the second end cap extending away from the end panel, the perimetral rim of the second end cap being configured to cover a portion of the cover adjacent to the second end edge.

Cover 58 includes a first end edge 94, shown in FIG. 3, a second end edge 96, shown in FIG. 7, a first side edge 98, and a second side edge 100. In addition, cover 58 includes a dome 110 having a substantially arcuate contour and a pair of straight walls 112 appended to and extending downwardly from dome 110. First end edge 94 includes an arcuate edge portion 114 positioned to lie in an inclined reference plane 116 that is non-orthogonal and non-parallel with a vertical reference plane 118 extending transversely with respect to casket 40. First end edge 94 also includes a pair of straight edge portions 120 as shown in FIG. 3. Arcuate edge portion 114 of cover 58 is configured so that the inclination of reference plane 116 relative to plane 118 is substantially equivalent to the inclination of beveled wall 76 relative to vertical wall 82.

Figure 11:
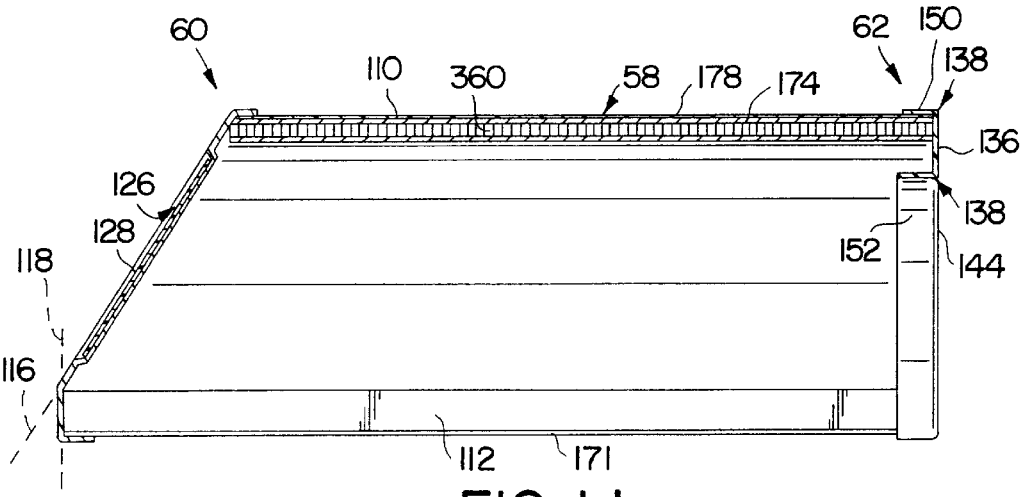
FIG. 11 is a sectional view of the head end lid half of FIG. 1 without a decorative liner showing the perimetral rims of the first and second end caps surrounding opposite ends of the cover of the head end lid half which extends between the first and second end caps.

First end cap 60 couples to cover 58 adjacent to first end edge 94 such that arcuate edge portion 114 is adjacent to interior surface 130 of beveled wall 76 and such that straight edge portions 120 are adjacent to interior surface 132 of vertical wall 82 as shown in FIGS. 3 and 11. In addition, perimetral rim 74 surrounds cover 58 in the region adjacent to first end edge 94 such that arcuate upper band 88 of perimetral rim 74 covers a portion 122 of dome 110 adjacent to arcuate edge portion 114, side bands 92 of perimetral rim 74 cover respective portions 124 of straight walls 112 adjacent to respective straight edge portions 120, and lower band 90 extends underneath straight walls 112 adjacent to first and second side edges 98, 110 of cover 58.

Beveled wall 76 of first end cap 60 is formed to include a shallow recess 126 and a decorative decal 128, shown in FIG. 11, is adhered to beveled wall 76 in shallow recess 126. In preferred embodiments, decorative decal 128 is made from a material that matches the material from which the exterior surfaces of other parts of casket 40 are made. Decorative decal 128 can be, for example, vinyl, aluminum, or cloth and can have any of a number of colors and textures.

Figure 8:
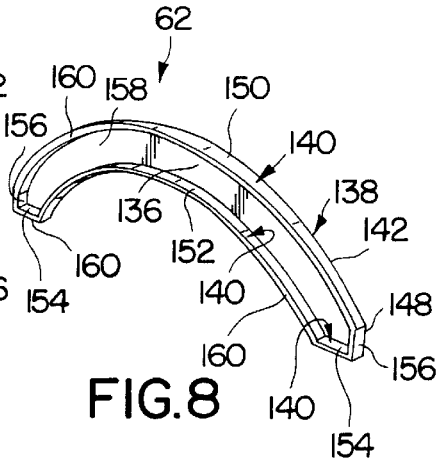
FIG. 8 is a perspective view of the second end cap of FIG. 7 showing an interior surface of the end panel of the second end cap and the perimetral rim of the second end cap having a rim edge spaced apart from the interior surface.
Figure 9:
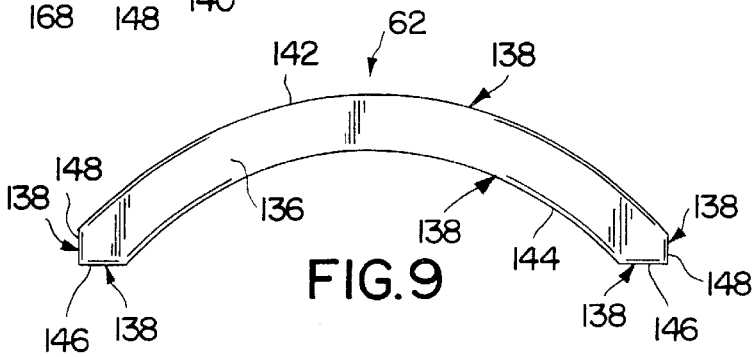
FIG. 9 is an end elevation view of the second end cap of FIG. 8 showing an upper perimeter portion of the crescent-shaped end panel having an arcuate shape and a lower perimeter portion of the crescent-shaped end panel having an arcuate shape.
Figure 10:
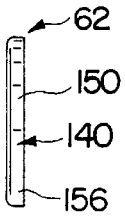
FIG. 10 is a side elevation view of the second end cap of FIG. 9 showing the perimetral rim of the second end cap having a substantially uniform width.

Second end cap 62 includes an end panel 136 with a perimeter 138 and a perimetral rim 140 extending away from perimeter 138 of end panel 136 as shown in FIGS. 7 and 8. End panel 136 is a substantially vertical, crescent-shaped panel having an arcuate upper perimeter portion 142 and an arcuate lower perimeter portion 144 spaced apart from upper perimeter portion 142 in substantially concentric relation therewith. End panel 136 includes a pair of straight lower perimeter portions 146 and a pair of straight side perimeter portions 148. Thus, perimeter 138 includes perimeter portions 142, 144, 146, 148. Although end panel 136 is shown in FIGS. 7–11 as being a flat planar panel, in preferred embodiments, end panel 136 is formed to include a decorative recess that generally follows the shape of perimeter 138 but that is smaller than end panel 136. It is within the scope of the invention as presently perceived for end panel 136 to include a decorative decal received in the recess.

Perimetral rim 140 includes an arcuate upper band 150 appended to and extending longitudinally from arcuate upper perimeter portion 142, an arcuate lower band 152 appended to and extending longitudinally from arcuate lower perimeter portion 144, a pair of straight lower bands 154 appended to and extending longitudinally from respective straight lower perimeter portions 146, and a pair of straight side bands 156 appended to and extending longitudinally from respective straight side perimeter portions 148. Bands 150, 152, 154, 156 are integrally appended to one another to form a contiguous band around perimeter 138 of end panel 136 such that perimetral rim 140 and perimeter 138 have substantially the same shape.

End panel 136 includes an interior surface 158 as shown in FIG. 8. Perimetral rim 140 includes a rim edge 160 that is spaced apart from interior surface 158 by a longitudinal distance that is substantially uniform about perimeter 138 and that is substantially equivalent to the longitudinal distance that rim edge 134 of perimetral rim 140 is spaced apart from interior surfaces 130, 132 of end panel 136. In addition, the material thickness of bands 150, 152, 154, 156 of perimetral rim 140 are substantially uniform between end panel 136 and rim edge 160 and are substantially equivalent to the material thickness of perimetral rim 74 of first end cap 60. In preferred embodiments, the material thickness of perimetral rim 140 is substantially equivalent to the material thickness of end panel 136. However, there may be a small amount of thickness variation in perimetral rim 140 and in end panel 136 due to material thickness variations that inherently occur when parts are made by a vacuum forming operation.

Cover 58 includes second end edge 96 as previously described. Second end edge 96 includes an arcuate edge portion 162 and a pair of straight edge portions 164 extending downwardly from arcuate edge portion 162. Edge portions 162, 164 are each positioned to lie in a plane (not shown) that is parallel with vertical reference plane 118. Second end cap 62 couples to cover 58 adjacent to second end edge 96 such that edge portions 162, 164 are adjacent to interior surface 158 of end panel 136 as shown in FIGS. 7 and 11. In addition, perimetral rim 140 surrounds cover 58 in the region adjacent to second end edge 96 such that arcuate upper band 150 of perimetral rim 140 covers a portion 166 of dome 110 adjacent to arcuate edge portion 142, straight side bands 156 of perimetral rim 140 cover respective portions 168 of straight walls 112 adjacent to respective straight side edge portions 164, straight lower bands 154 of perimetral rim 140 extend underneath straight walls 112 adjacent to first and second side edges 98, 110 of cover 58, and arcuate lower band 152 of perimetral rim 140 extends between lower bands 154 in spaced apart relation with cover 58.

Casket 40 includes a lid insert 170 as shown, for example, in FIG. 2 that couples to lid half 46. Band 90 of perimetral rim 74 of first end cap 60 and bands 152, 154 of perimetral rim 140 of second end cap 62 act as retainers to retain lid insert 170 in lid half 46 after lid insert 170 is pushed into lid half 46. Lid half 46 further includes ledges 171, shown in FIGS. 3, 7, and 11, which also act as retainers to retain lid insert 170 in lid half 46.

In preferred embodiments, cover portions 58, 64 to which end caps 60, 62, 66, 68 are mounted, are made of a plurality of flexible paperboard elements that are adhered together as will be discussed below in more detail with reference to FIGS. 12–15 and 18–24. However, it is within the scope of the invention as presently perceived for end caps 60, 62, 66, 68 to be included as components of casket lids (not shown) that are made of wood, metal, or other materials including various types of rigid materials and flexible materials. Forming end caps 60, 62, 66, 68 as single contiguous pieces, such as by molding end caps 60, 62, 66, 68 from plastics material, allows end caps 60, 62, 66, 68 to be manufactured at a cost that is lower than other types of end caps that are made of separate pieces requiring machining operations to form the separate pieces into the desired shape.

Figure 12:
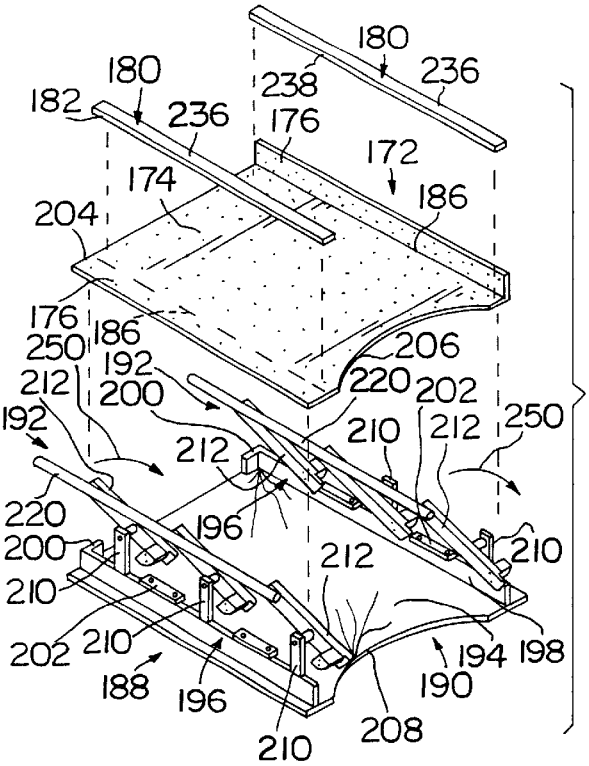
FIGS. 12–24 show a sequence of steps by which each of the lid halves are made.

Cover 58 of lid half 46 includes an outer surface element 172 having a central cover portion 174 and a pair of longitudinal edge flaps 176 appended to cover portion 174 as shown in FIG. 12. In preferred embodiments, element 172 is made of a flexible paperboard material having a decorative exterior sheet 178 attached thereto as shown in FIG. 11. Cover 58 also includes a pair of side rails 180 that are coupled to outer surface element 172 and that extend the longitudinal length of element 172. A pair of score or fold lines 186 are formed in element 172 to permit edge flaps 176 to be folded relative to cover portion 174 as shown in FIG. 12. Each side rail 180 is coupled to element 172 so that a first surface 182 of side rail 180, shown in FIGS. 12 and 15 (in phantom), abuts the respective edge flap 176 and so that a second surface 184 of side rail 180, shown in FIG. 15 (in phantom), abuts cover portion 174 adjacent to the respective edge flap 176.

Figure 13:
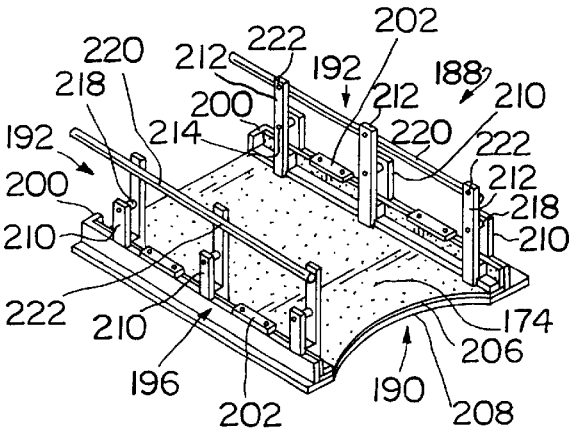

A fixture 188 used during attachment of side rails 180 to element 172 includes a table 190 and a pair of clamping assemblies 192 coupled to table 190 as shown in FIGS. 12 and 13. Table 190 includes an upwardly facing top surface 194 configured to support element 172 during attachment of side rails 180 thereto. Clamping assemblies 192 each include a fixture rail 196 having a respective flap-engaging surface 198 as shown in FIG. 12. A pair of transverse stops 200 extend from one end of each fixture rail 196. Fixture 188 is configured so that when element 172 is placed on top surface 194 in a proper position, edge flaps 176 engage respective flap-engaging surfaces 198 and a straight edge 204 of element 172 engages stops 200. In addition, an arcuate edge 206 of element 172 is adjacent to an arcuate edge 208 of table 190 when element 172 is placed on top surface 194 in the proper position.

Clamping assemblies 192 include a set of keeper plates 202 attached to fixture rails 196 and arranged to extend over portions of edge flaps 176 when element 172 is placed on top surface 194 of table 190. After element 172 is placed on table 190, adhesive is applied to cover portion 174 and to edge flaps 176 adjacent to respective fold lines 186. Side rails 180 are then placed on element 172 so that first surfaces 182 contact the adhesive on the respective edge flap 176 and so that second surfaces 184 contacts the adhesive on cover portion 174.

Figure 14:
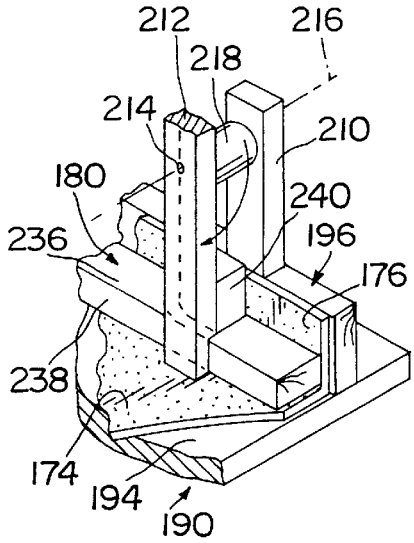

Each clamping assembly 192 includes three support arms 210 extending upwardly from respective fixture rails 196 as shown in FIGS. 12 and 13. Each clamping assembly 192 also includes three clamp arms 212 coupled to respective support arms 210 by pivot pins 214 for pivoting movement about respective horizontal pivot axes 216, one of which is shown in FIG. 14. A spacer 218 is mounted on each pivot pin 214 and is positioned to lie between each clamp arm 212 and the respective support arm 210. In addition, each clamping assembly 192 includes a moveable horizontal rail 220 coupled to respective clamp arms 212 by pivot pins 222.

Rails 220 are moveable between a first position in which clamp arms 212 are in a releasing position inclined relative to top surface 194 of table 190, as shown in FIG. 12, and a second position in which clamp arms 212 are in a clamping position substantially vertical and perpendicular to top surface 194 of table 190, as shown in FIG. 13. Clamping assemblies 192 are configured so that rails 220 are maintained in parallel relation with top surface 194 of table 190 as rails 220 are moved between the first and second positions and so that clamp arms 212 are maintained in parallel relation with one another as rails 220 are moved between the first and second positions to move clamp arms 212 between the releasing and clamping positions.

Figure 15:
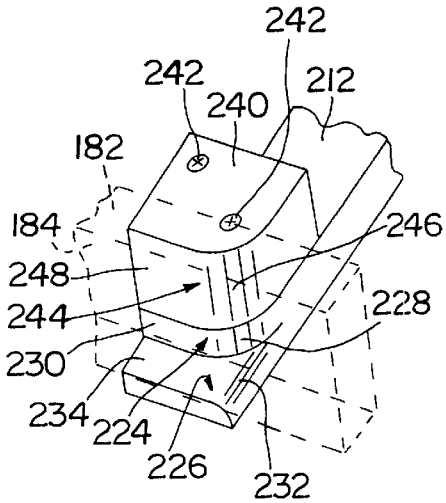

A lower portion of each clamp arm 212 is formed to include a first clamping surface 224 and a second clamping surface 226 as shown in FIG. 15. Clamping surface 224 includes a rounded camming portion 228 and a planar abutment portion 230 that blends smoothly with camming portion 228. Clamping surface 226 includes a rounded camming portion 232 and a planar abutment portion 234 that blends smoothly with camming portion 232. Clamping assemblies 192 include a plurality of clamp-extender blocks 240, each of which are fastened to respective clamp arms 210 by, for example, screws 242 as shown in FIG. 15. Each clamp-extender block 240 includes a clamping surface 244 having a rounded camming portion 246 and a planar abutment portion 248 that blends smoothly with camming portion 246. Camming portions 246 of blocks 242 are substantially coplanar with camming portions 228 of respective clamp arms 210 and abutment portions 248 are substantially coplanar with abutment portions 230 of respective clamp arms 212 as shown in FIG. 15.

As clamp arms 212 move from the releasing position to the clamping position in a direction indicated by arrows 250 of FIG. 12, each of camming portions 228, 246 cams against a top surface 236 of the respective side rail 180 to increase the pressure with which side rails 180 are pressed against cover portion 174 of element 172 and each camming portion 232 cams against a side surface 238 of the respective side rail 180 to increase the pressure with which side rails 180 are pressed against respective edge flaps 176 of element 172. When clamp arms 212 are in the clamping position, each of abutment portions 230, 248 engages the respective surface 236 of side rails 180 to clamp side rails 180 against cover portion 174 tightly and each abutment portion 234 engages the respective surface 238 of side rails 180 to clamp side rails 180 against edge flaps 176 tightly.

Increasing the pressure with which side rails 180 are pressed against element 172 by moving clamp arms 212 in direction 250 to the respective clamping positions, causes the adhesive between side rails 180 and element 172 to spread over a larger surface area than if side rails 180 engaged element 172 with a lesser pressure. In addition, increasing the pressure with which side rails 180 are pressed against element 172 also increases the pressure with which edge flaps 176 are pressed against fixture rails 196 and increases the pressure with which cover portion 174 is pressed against table 190, thereby tending to flatten out any warpage in side rails 180 and element 172. Thus, clamping fixtures 192 are operable to enhance the uniformity with which the adhesive between side rails 180 and element 172 adheres side rails 180 to element 172.

Casket 40 includes head end lid half 46 and foot end lid half 47 that are each movable relative to casket shell 42 between opened and closed positions as previously described. Casket 40 includes a head end lid brace 252, shown in FIGS. 2, 17, and 37, that supports head end lid half 46 in the opened position relative to casket shell 42. Casket 40 also includes a foot end lid brace 254, shown in FIGS. 16 and 37, that supports foot end lid half 47 in the opened position relative to casket shell 40. Lid brace 252 is mounted to a head end brace block 256 which is adhered to end cap 60 as shown in FIG. 17 and lid brace 254 is mounted to a foot end brace block 258 which is adhered to end cap 66 as shown in FIG. 16.

Figure 16:
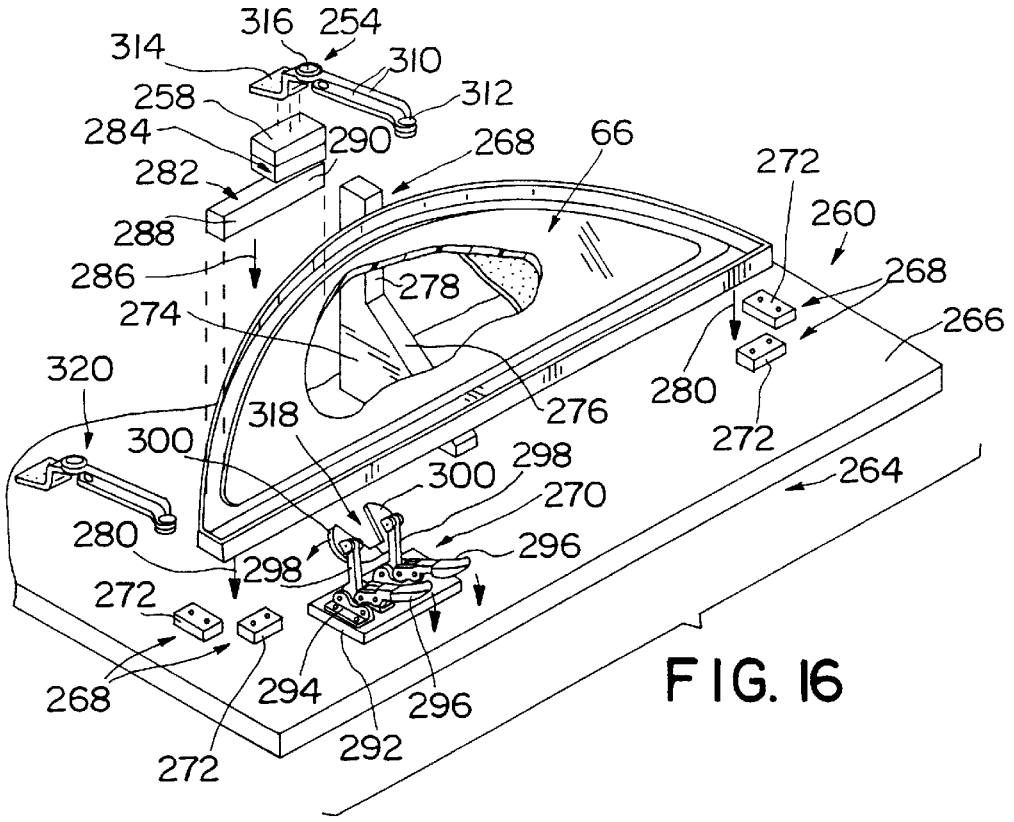
Figure 17:
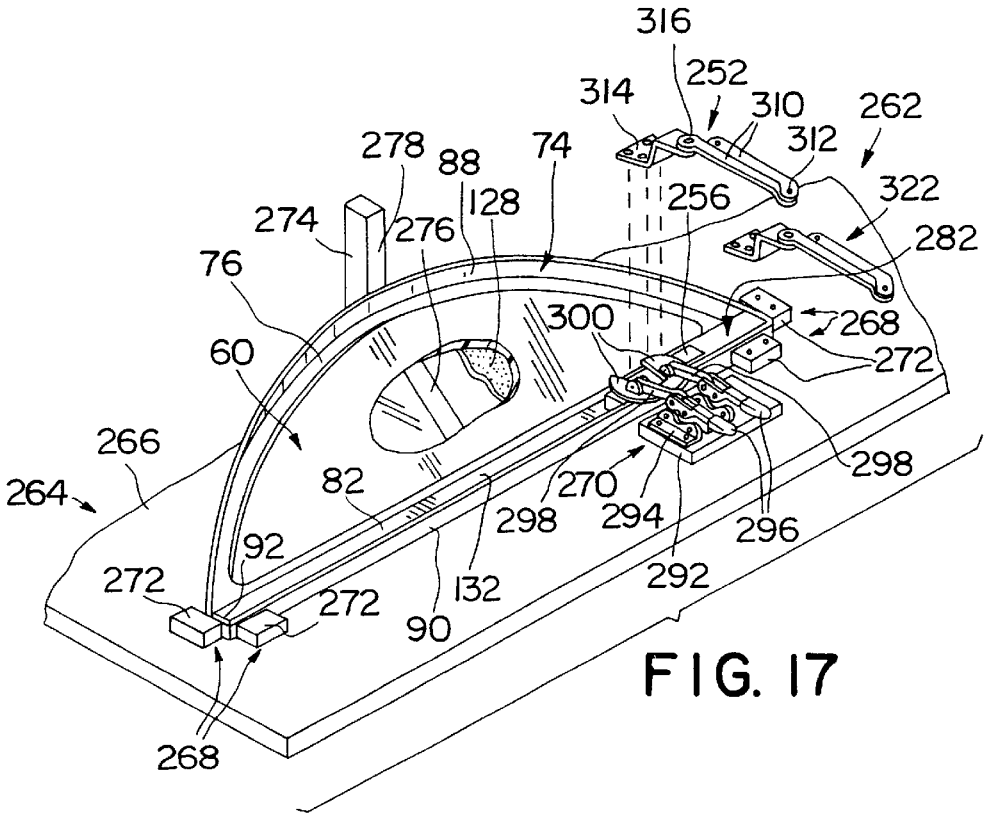

A foot end lid-brace attachment fixture 260 used during attachment of brace 254 and block 258 to end cap 66 is shown in FIG. 16 and a head end lid-brace attachment fixture 262 used during attachment of brace 252 and block 256 to end cap 60 is shown in FIG. 17. Fixtures 260, 262 each include a table 264 having an upwardly facing top surface 266. In addition, fixtures 260, 262 each include a set of positioners 268 mounted to top surface 266 of the respective table 264. Fixtures 260, 262 also each include a clamp assembly 270 mounted to top surface 266 of the respective table 264 as shown in FIGS. 16 and 17. Clamp assembly 270 of fixture 260 is situated relative to the respective positioners 268 so as to be able to clamp block 258 against end cap 66 at a position that allows brace 254 to be mounted to block 258 at a proper position whereas clamp assembly 270 of fixture 262 is situated relative to the respective positioners 268 so as to be able to clamp block 256 against end cap 60 at a position that allows brace 252 to be mounted to block 256 at a proper position. Thus, the key difference between fixtures 260, 262 is the position of the respective clamp assembly 270 relative to the associated positioners 268.

Positioners 268 of fixtures 260, 262 each include four corner blocks 272 and a positioning fin 274 as shown in FIGS. 16 and 17. Each positioning fin 274 includes an inclined surface 276 and a vertical surface 278. Positioners 268 are configured to support end caps 60, 66 in proper orientations relative to tables 264 of respective fixtures 260, 262. For example, when end cap 60 is placed on fixture 262, as shown in FIG. 17, beveled wall 76 of end panel 70 engages inclined surface 276 of positioning fin 274, vertical wall 82 of end panel 70 engages top surface 266 of table 264, upper band 88 of perimetral rim 74 engages vertical surface 278 of positioning fin 274, lower band 90 of perimetral rim 74 engages one pair of corner blocks 272, and side bands 92 engage another pair of corner blocks 272. Like portions of end cap 66 engage like portions of fixture 260 when end cap 66 is moved from a position above fixture 260 in the direction of arrows 280, shown in FIG. 16, into engagement with table 264, blocks 272, and positioning fin 274 of fixture 260.

Fixtures 260, 262 each include a spacer template 282 having a cut-out 284 sized to receive a portion of the respective brace block 256, 258 as shown best in FIG. 16 with reference to spacer template 282 used with block 258. Spacer template 282 used to position block 256 relative to end cap 60 is placed on interior surface 132 of vertical wall 82 near clamp assembly 270 of fixture 262 and in contact with bands 90, 92 of perimetral rim 74 as shown in FIG. 17. Like portions of end cap 66 near clamp assembly 270 of fixture 260 engage the spacer template 282 associated with block 258 when the spacer template 282 associated with block 258 is moved from the position above end cap 66 in the direction of arrow 286, shown in FIG. 16, into engagement with end cap 66.

Each spacer template 282 includes a large portion 288 and a thin portion 290 extending away from large portion 288 as shown in FIG. 16 with reference to spacer template 282 associated with block 258. After spacer templates 282 are situated properly on respective end caps 60, 66, adhesive is applied to bottom surfaces (not shown) of blocks 256, 258 and blocks 256, 258 are placed in cut-outs 284 of respective spacer templates 282 so that the bottom surfaces engage respective end caps 60, 66 and so that blocks 256, 258 engage respective large portions 288 and respective thin portions 290 as shown in FIG. 17 with reference to spacer template 282 associated with block 256. Engagement between blocks 256, 258 and spacer templates 282 ensures that blocks 256, 258 are at proper positions relative to respective end caps 60, 66. In addition, thin portions 290 of spacer templates 282 are configured so that when spacer templates 282 are moved away from end caps 60, 66 after attachment of blocks 256, 258 to end caps 60, 66, a lid insert-receiving gap exists between blocks 256, 258 and the associated perimetral rim of end caps 60, 66. For example, when block 282 is pulled away from end cap 60, the gap between block 256 and band 90 of perimetral rim 74 is of sufficient size to receive a portion of lid insert 170 when lid insert 170 is attached to lid half 46.

Each clamp assembly 270 includes a pedestal block 292 mounted to top surface 266 of the respective table 264 and a bracket pair 294 mounted to the respective pedestal block 292 as shown in FIGS. 16 and 17. Each clamp assembly 270 further includes a handle pair 296 coupled to the respective bracket pair 294 for pivoting movement, a link pair 298 coupled to the respective bracket pair 294 for pivoting movement, and a clamp pad pair 300 coupled to distal ends of the respective link pair 298. Each handle pair 296 is also pivotably coupled to the respective link pair 298 so that movement of handle pairs 296 relative to associated bracket pairs 294 causes movement of respective link pairs 298 relative to associated bracket pairs 294.

Handle pairs 296 are each moveable between a releasing position, shown in FIG. 16 with reference to clamp assembly 270 of fixture 260, in which link pairs 298 are in a substantially vertical orientation having clamp pad pairs 300 positioned to lie above the respective pedestal block 292 and a clamping position, shown in FIG. 17 with reference to clamp assembly 270 of fixture 262, in which link pairs 298 are in a substantially horizontal orientation having clamp pad pairs 300 engaging respective blocks 256, 258 to press blocks 256, 258 against respective end caps 60, 66. Pressing blocks 256, 258 against respective end caps 60, 66 by moving handle pairs 296 from the releasing position to the clamping position, enhances the uniformity with which blocks 256, 258 adhere to respective end caps 60, 66.

Casket 40 includes head end lid brace 252 that supports head end lid half 46 in the opened position and foot end lid brace 254 that supports foot end lid half 47 in the opened position as previously described. Braces 252, 254 each include a pair of links 310 that are pivotably coupled together by a pivot pin 312 as shown in FIGS. 16 and 17. In addition, braces 252, 254 each include a brace flange 314 pivotably coupled to one of the associated links 310 by a pivot pin 316. A block-engaging portion of each brace flange 314 has a substantially trapezoidal shape and clamp pad pairs 300 of clamp assemblies 270 are each formed to include a trapezoidal-shaped cut-out 318 as shown best in FIG. 16. When handle pairs 296 are in the respective clamping positions having clamp pad pairs 300 engaging respective blocks 256, 258, the block-engaging portion of brace flanges 314 are placed in cut-outs 318 and braces 252, 254 are fastened to blocks 256, 258 with suitable fasteners (not shown) such as, for example, wood screws. Receipt of the block-engaging portions of brace flanges 314 in cut-outs 318 ensures that brace flanges 314 are fastened to respective blocks 256, 258 at proper positions.

Fixture 260 includes a foot end lid-brace sample 320, shown in FIG. 16, and fixture 262 includes a head end lid-brace sample 322, shown in FIG. 17. Lid-brace samples 320, 322 are mounted to top surfaces 266 of respective tables 264. Lid-brace sample 320 is representative of lid brace 254 and is configured to match the orientation at which lid brace 254 is to be fastened to block 258. Likewise, lid-brace sample 322 is representative of lid brace 252 and is configured to match the orientation at which lid brace 252 is to be fastened to block 256. Thus, lid-brace samples 320, 322 minimize the probability that lid brace 252 will be fastened to block 258 inadvertently and that lid brace 254 will be fastened to block 256 inadvertently.

A lid press fixture 330 used during construction of covers 58, 64 and used during attachment of end caps 60, 62, 66, 68 to respective covers 58, 64 includes a frame 332, a fixed lid-half press 334, and a moveable lid-half press 336 as shown in FIGS. 18–21. Press 334 includes a stationary base 338, a truss 340 coupled to base 338 for pivoting movement, and a first press head 342 coupled to truss 340. Press 336 includes a moveable base 344, a truss 346 coupled to base 344 for pivoting movement, and a second press head 358 coupled to truss 346. Base 338 includes an upwardly facing concave surface 350 and press head 342 includes a convex surface 352. Likewise, base 344 includes an upwardly facing concave surface 354 and press head 348 includes a convex surface 356. In addition, each of bases 338, 344 includes a pair of transversely spaced apart side walls 349, a first end wall 351, and a second end wall 353 longitudinally spaced apart from first end wall 351.

Figure 18:
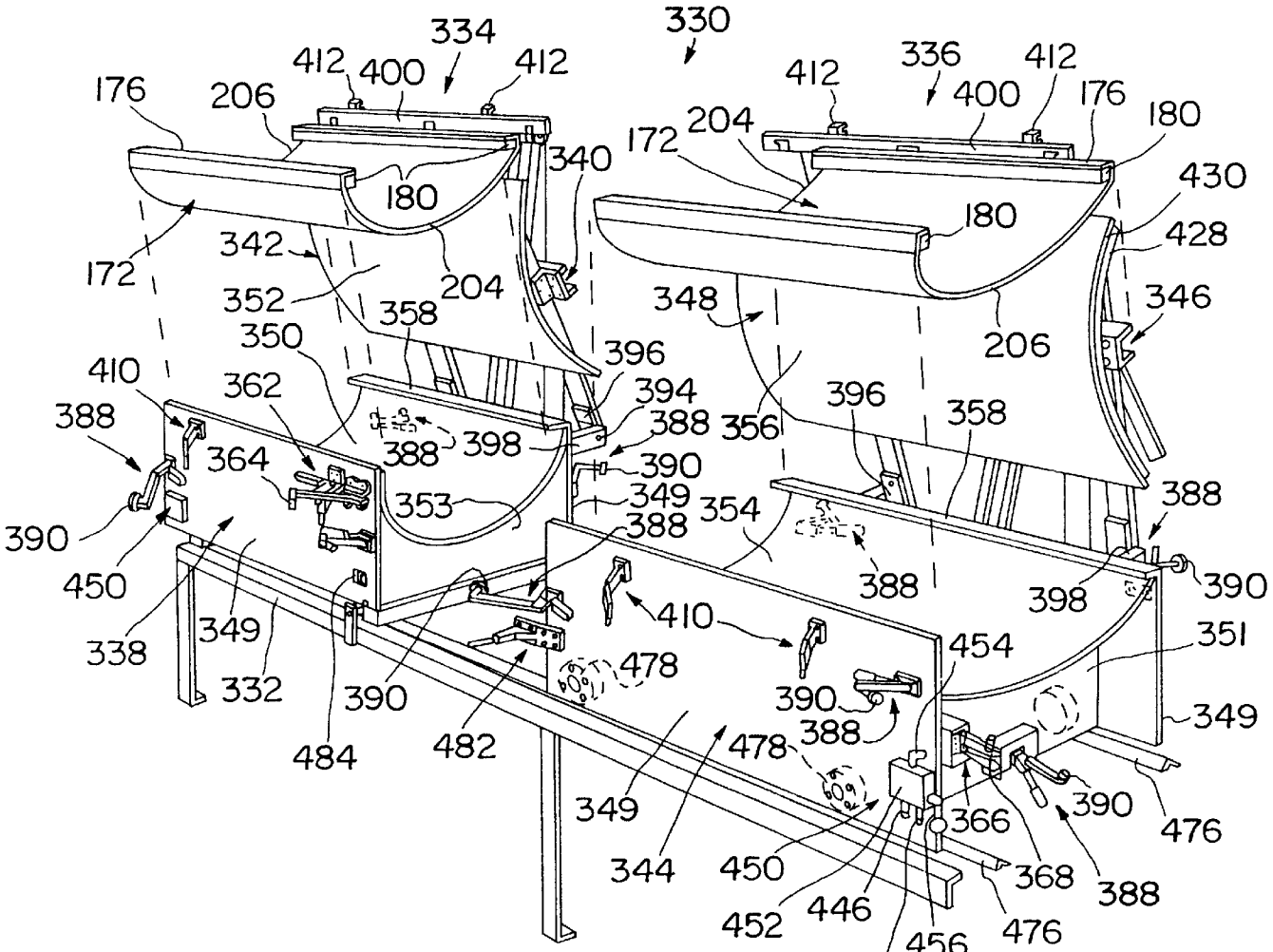
Figure 19:
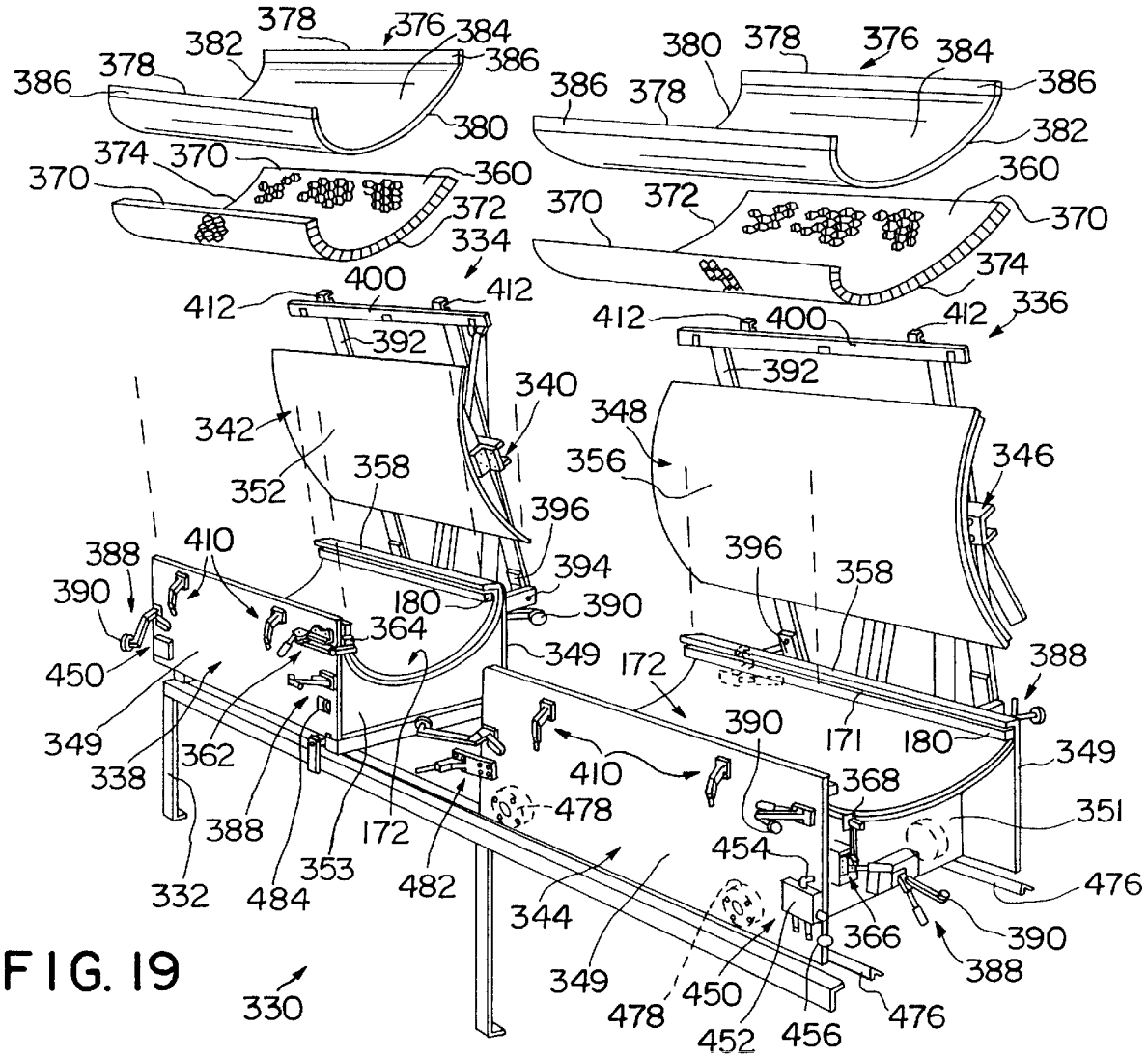
Figure 20:
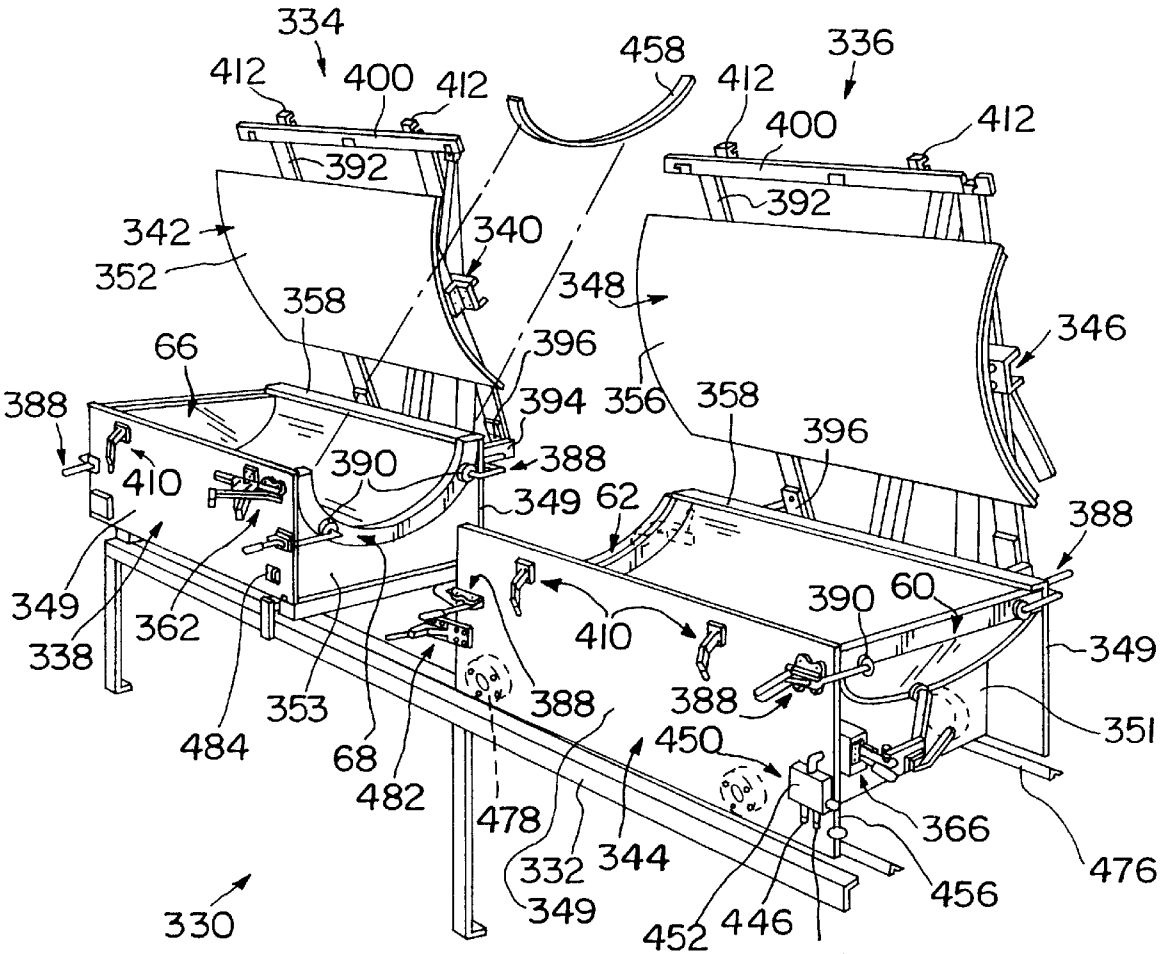
Figure 21:
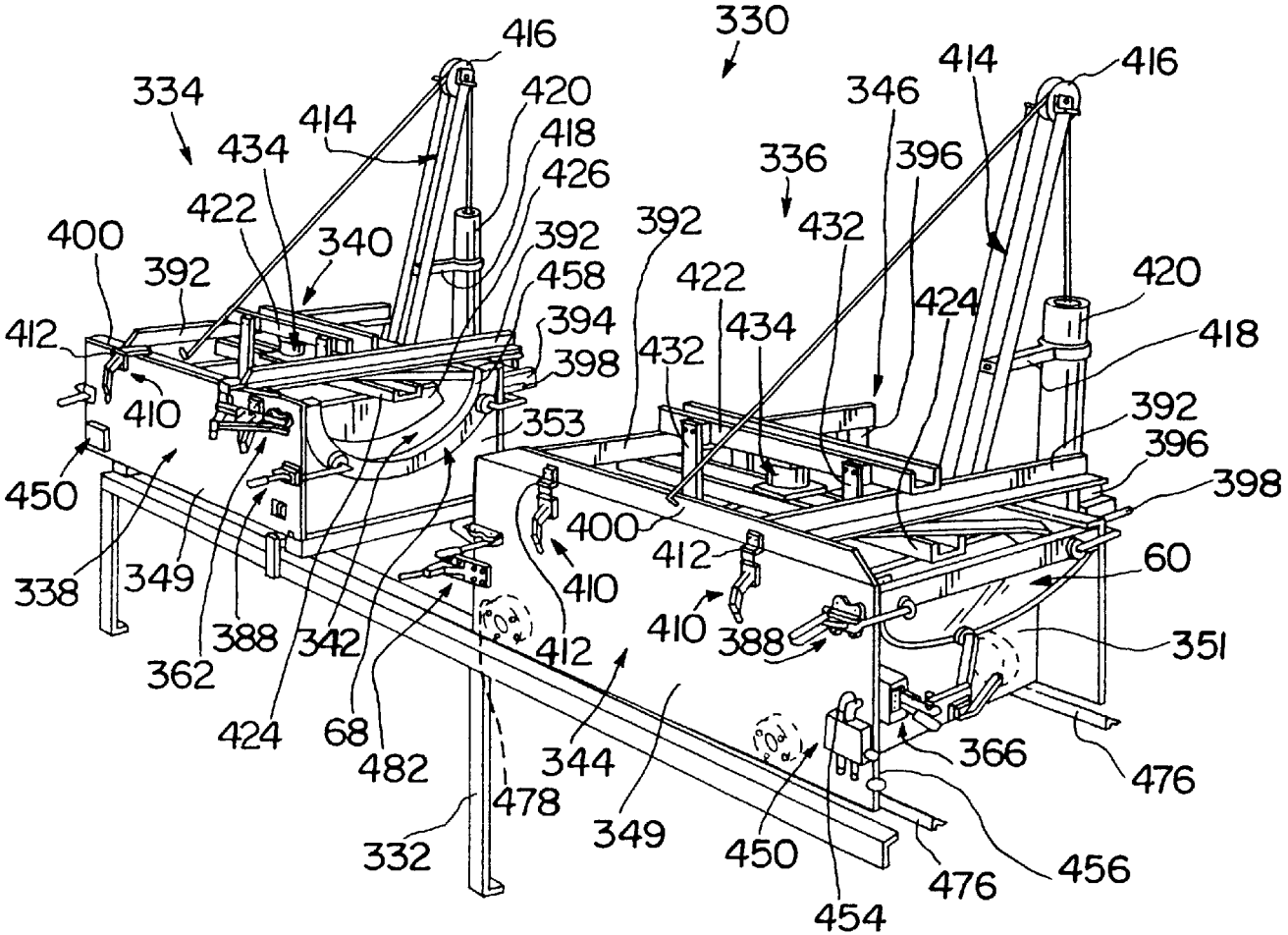

Trusses 340, 346 are each moveable between a raised position, shown in FIGS. 18–20, in which trusses 340, 346 angle upwardly from respective bases 338, 344 and a lowered position, shown in FIG. 21, in which trusses 340, 346 extend horizontally over concave surfaces 350, 354 of respective bases 338, 344. When trusses 340, 346 are in the raised position as shown, for example, in FIG. 18, convex surfaces 352, 356 of respective press heads 342, 348 are in respective release positions moved away from concave surfaces 350, 354 of respective bases 338, 344. After side rails 180 are attached to a pair of outer surface elements 172 using fixture 188 as previously described, outer surface elements 172 with side rails 180 attached thereto are flexed from a planar configuration, shown in FIG. 13, into an arcuate configuration, shown in FIG. 18, and are then placed onto respective concave surfaces 350, 354 as shown in FIG. 19.

Each press 334, 336 includes an overhanging rail 358 attached to respective bases 338, 344 so as to overhang a portion of concave surfaces 350, 354 as shown in FIG. 18. When outer surface elements 172 with side rails 180 attached thereto are placed onto respective concave surfaces 350, 354, one edge flap 176 of each respective outer surface element 172 contacts a respective undersurface (not shown) of overhanging rails 358 as shown in FIG. 19. Frictional contact between cover portions 174 of elements 172 and respective concave surfaces 350, 354 and contact between edge flaps 176 and the associated overhanging rails 358 prevents outer surface elements 172 from unflexing out of the arcuate configuration back into the planar configuration. After outer surface elements 172 with side rails 180 attached thereto are placed onto respective concave surface 350, 354, a coat or layer of adhesive is applied to cover portion 174 between side rails 180.

Press 334 includes a first positioning clamp 362 having a first positioning plate 364. In addition, press 336 includes a second positioning clamp 366 having a second positioning plate 368. First positioning clamp 362 is mounted to one of side walls 349 of base 338 and second positioning clamp 366 is mounted to end wall 351 of base 344. Positioning clamps 362, 366 each are moveable between a retracted position, shown in FIG. 18, in which the associated positioning plate 364, 368 is moved away from the respective concave surface 350, 354 and an extended position, shown in FIG. 19, in which the associated positioning plate 364, 368 is adjacent to the respective concave surface 350, 354. After positioning clamps 362, 366 are in the extended positions, the longitudinal position of outer surface elements 172 relative to respective concave surfaces 350, 354 is adjusted so that straight edge 204 of element 172 supported on base 338 engages plate 364 and so that arcuate edge 206 of element 172 supported on base 344 engages plate 368 as shown in FIG. 19.

Covers 58, 64 each include a honeycomb core 360 having a pair of longitudinal side edges 370, a straight transverse edge 372, and an arcuate transverse edge 374 as shown in FIG. 19. After the layer of adhesive is applied to elements 172 between side rails 180 and after positioning clamps 362, 366 are both moved to the respective extended positions, cores 360 are placed onto elements 172 between side rails 180. Plates 364, 368 facilitate the placement of cores 360 onto elements 172. For example, as core 360 is placed on element 172 which is supported by base 338, edge 372 engages plate 364 while the associated core 360 is held at an inclined orientation relative to the respective element 172 so that core 360 is out of contact with the adhesive applied to the associated element 172. Then, core 360 associated with element 172 supported by base 338 is moved from the inclined orientation relative to the respective element 172 to an orientation flush with the respective element 172 so that core 172 contacts the adhesive applied to the associated element 172.

As core 360 associated with element 172 supported by base 338 is moved from the inclined orientation to the orientation flush with the respective element 172, edge 372 is maintained in contact with plate 364 so that when core 360 reaches the flush orientation, core 360 is at a proper position relative to element 172 having edge 372 aligned with edge 204 of the respective element 172. Core 360 associated with element 172 supported by base 344 is placed on the respective element 172 in a similar manner except that edge 374 of core 360 is maintained in contact with plate 368 as the associated core 360 is moved from an inclined orientation to an orientation flush with the respective element 172. After cores 360 are placed on respective elements 172, edges 370 of respective cores 360 are in contact with surfaces 238, shown in FIG. 12, of respective side rails 180. Each core 360 is initially in an unflexed or planar configuration (not shown) and is flexed into an arcuate configuration, shown in FIG. 19, before placement on the respective element 172. Engagement of edges 370 with side rails 180 after placement of cores 360 on elements 172 prevents cores 360 from unflexing out of the arcuate configuration back into the planar configuration. Rails 180 are sized to have a thickness that is substantially equivalent to the thickness of cores 360 so that edges 370 of cores 360 substantially cover surfaces 238 of respective side rails 180.

Covers 58, 64 each include an inner surface element 376 having a pair of longitudinal side edges 378, a straight transverse edge 380, and a substantially arcuate transverse edge 382 as shown in FIG. 19. Each inner surface element 376 includes a central cover portion 384 and a pair of edge flaps 386 appended to cover portion 384. After cores 360 are placed onto respective elements 172, a coat or layer of adhesive is applied to cores 360 and then elements 376 are placed onto cores 360. Plates 364, 368 facilitate the placement of elements 376 onto cores 360 in substantially the same manner that plates 364, 368 facilitate the placement of cores 360 on elements 172 except that edge 380 of one of elements 376 is maintained in contact with plate 364 as the associated element 376 is moved from an inclined orientation to an orientation flush with the respective core 360 and edge 382 of the other of elements 376 is maintained in contact with plate 368 as the associated element 376 is moved from an inclined orientation to an orientation flush with the respective core 360.

After elements 376 are placed on respective cores 360, edge flaps 386 of respective elements 376 are positioned so as to cover surfaces 236 of respective side rails 180. Each element 376 is initially in an unflexed, planar configuration (not shown) and is flexed into an arcuate configuration, shown in FIG. 19, before placement on the respective core 360. After placement of elements 376 on cores 360, edges 378 of element 376 engage ledges 171 which are provided by respective edge flaps 176 of elements 172 and which overhang the associated side rails 180.

Engagement of edges 378 with ledges 171 after placement of elements 376 on cores 360 prevents cores 360 from unflexing out of the arcuate configuration back into the planar configuration.

Thus, during the construction of covers 58, 64, elements 172 with side rails 180 attached thereto, cores 360, and elements 372 are stacked on concave surfaces 350, 354 of respective bases 338, 334 with the assistance of plates 364, 368 of respective positioning clamps 362, 366. As elements 172 with side rails 180 attached thereto, cores 360, and elements 376 are stacked on bases 338, 334, adhesive is applied to the upwardly facing surfaces of elements 172 and cores 360. After elements 172 with side rails 180 attached thereto, cores 360, and elements 376 are stacked on bases 338, 334, edges 204, 372, 380 are aligned so as to form end edges 96 of respective covers 58, 64 and edges 206, 374, 382 are aligned so as to form end edges 94 of respective covers 58, 64. In addition, after elements 172 with side rails 180 attached thereto, cores 360, and elements 376 are placed on respective bases 338, 344 as described above, positioning clamps 362, 366 are moved back to the respective retracted positions having plates 364, 368 moved away from covers 58, 64.

Fixture 330 includes a plurality of end cap clamps 388, some of which are mounted to base 338 at various locations and some of which are mounted to base 344 at various locations. Each end cap clamp 388 includes a clamp pad 390 which, in preferred embodiments is made of rubber. Each clamp 388 is moveable between a releasing position, shown in FIGS. 18 and 19, in which clamp pads 390 are moved away from covers 58, 64 and a clamping position, shown in FIGS. 20 and 21, in which clamp pads 390 engage respective end caps 60, 62, 66, 68 to clamp end caps 60, 62, 66, 68 against respective covers 58, 64.

While clamps 388 are in the releasing positions, adhesive is applied to interior surfaces 130 of beveled walls 76 adjacent to arcuate upper bands 88 of respective end caps 60, 66 and adhesive is applied to interior surfaces 158 of end panels 136 adjacent to arcuate upper bands 150 of respective end caps 62, 68. After the adhesive is applied, end caps 60, 62, 66, 68 are placed against covers 58, 64 adjacent to the respective first and second end edges 94, 96 thereof so that perimetral rims 74, 140 surround portions 122, 124, 166, 168 of the associated covers 58, 64 adjacent to end edges 94, 96 thereof as described above with reference to FIGS. 3–11. After end caps 60, 62, 66, 68 are placed against covers 58, 64 as just described, clamps 388 are moved to respective clamping positions as shown in FIG. 20.

When clamps 388 are moved to the clamping positions, two of clamps 388 hold end cap 62 against end 96 of cover 58, two of clamps 388 hold end cap 68 against end 96 of cover 64, three of end clamps 388 hold end cap 60 against edge 94 of cover 58, and three of end clamps 388 hold end cap 66 edge 94 of cover 64. Clamping end caps 60, 62, 66, 68 against end edges 94, 96 of respective covers 58, 64 with clamps 388 enhances the uniformity with which the adhesive between end caps 60, 62, 66, 68 and covers 58, 64 adheres end caps 60, 62, 66, 68 to covers 58, 64. After clamps 388 are moved to the clamping positions as just described, a bead of hot, melted glue (not shown) is applied at the corners formed between end panels 70, 136 of associated end caps 60, 62, 66, 68 and inner surface elements 376 of respective covers 58, 64 to further secure end caps 60, 62, 66, 68 to the respective covers 58, 64.

After clamps 388 are moved to the clamping positions to clamp end caps 60, 62, 66, 68 against covers 58, 64 and after the beads of glue are applied, trusses 340, 346 are moved from the respective raised positions, shown, for example, in FIG. 20, to the respective lowered positions, shown in FIG. 21. When trusses 340, 346 are each moved from the raised position to the lowered position, press heads 342, 348 are each moved from the releasing position to the clamping position so that convex surfaces 352, 356 of respective press heads 342, 348 engage associated elements 376 to press elements 172, cores 360, and elements 376 together between concave surfaces 350, 354 and respective convex surfaces 352, 356.

Trusses 340, 346 each include a pair of transverse members 392, which are pivotably coupled to respective pivot rods 394 by bearing pillow block assemblies 396 as shown best in FIG. 21. Pivot rods 394 are supported by flanges 398 which extend from respective bases 338, 344. Trusses 340, 346 each include a longitudinal member 400 fixed to distal ends of respective transverse members 392. Fixture 330 includes four latches 410, two of which are mounted to one of side walls 349 of base 338 and two of which are mounted to one of side walls 349 of base 344. Fixture 330 also includes four hooks 412, two of which are mounted to one of members 400 and two of which are mounted to the other of members 400. When trusses 340, 346 are moved to respective lowered positions, each of latches 410 are manipulated to engage an associated one of hooks 412 to lock trusses 340, 346 in the lowered positions. Thus, latches 410 and hooks 412 provide fixture 330 with a set of latch assemblies that lock trusses 340, 346 relative to respective bases 338, 344. In addition, when trusses 340, 346 are moved to the respective lowered positions, members 400 engage the edge flaps 176 of elements 172 which oppose the edge flaps 176 that engage the bottom surface of overhanging rails 358 as previously described.

Fixture 330 includes a pair of pulley supports 414, one of which is mounted to base 338 and one of which is mounted to base 344 as shown best in FIG. 21. Pulleys 416 are mounted to the upper ends of respective pulley supports 414 for rotation relative thereto. Fixture 330 further includes a pair of tube supports 418 that are mounted to respective pulley supports 414 and a pair of vertical tubes 420 that are coupled to respective tube supports 418. A pair of counter weights (not shown) are situated inside respective tubes 420 and a pair of cables 422 are coupled to respective counter weights and to respective longitudinal members 400 of trusses 340, 346. Cables 422 are routed over pulleys 416 so that as trusses 342, 348 are moved between the raised and lowered positions, the counter weights move between lowered and raised positions, respectively, within tubes 420. Tubes 420 ensure that counter weights move substantially vertically without swinging.

The amount of weight of each counter weight and the positioning of pulleys 416 relative to respective bases 338, 344 are chosen so that when trusses 340, 346 are in the raised positions, the moment created by the weight of trusses 340, 346 and the weight of associated press heads 342, 348 to move trusses 340, 346 and press heads 342, 348 downwardly toward the lowered positions is less than the moment created by the weight of the counter weights to move trusses 340, 346 and press heads 342, 348 away from the lowered positions. In addition, the amount of weight of each counter weight and the positioning of pulleys 416 relative to respective bases 338, 344 are chosen so that when trusses 340, 346 are in the lowered positions, the moment created by the weight of the counter weights to move trusses 340, 346 and press heads 342, 348 away from the lowered positions is less than the moment created by the weight of trusses 340, 346 and the weight of associated press heads 342, 348 to keep trusses 340, 346 and press heads 342, 348 in the lowered positions. Thus, the counter weights facilitate the movement of trusses 340, 346 and press heads 342, 348 between the raised and lowered positions by counterbalancing some of the weight thereof.

Figure 22:
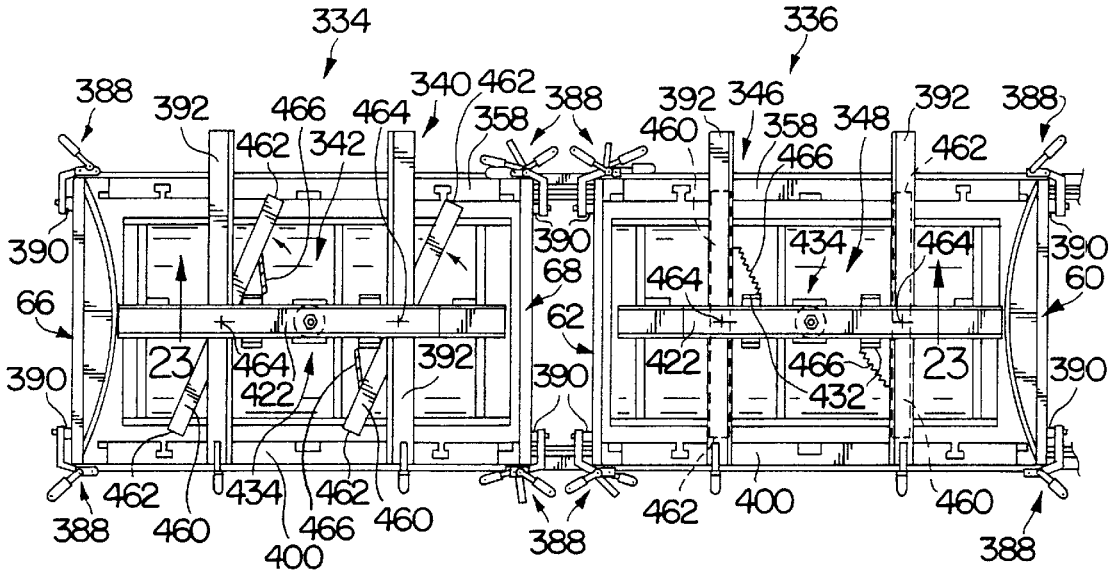
Figure 23:
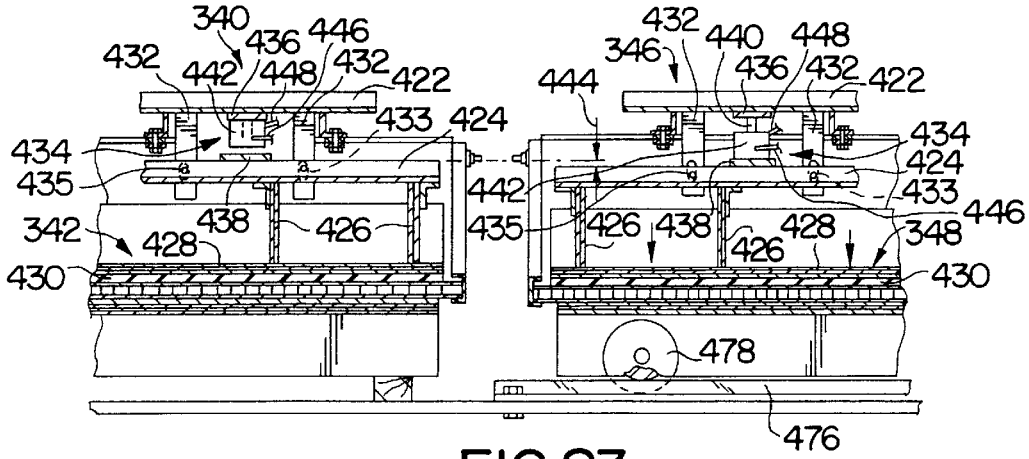
Figure 27:
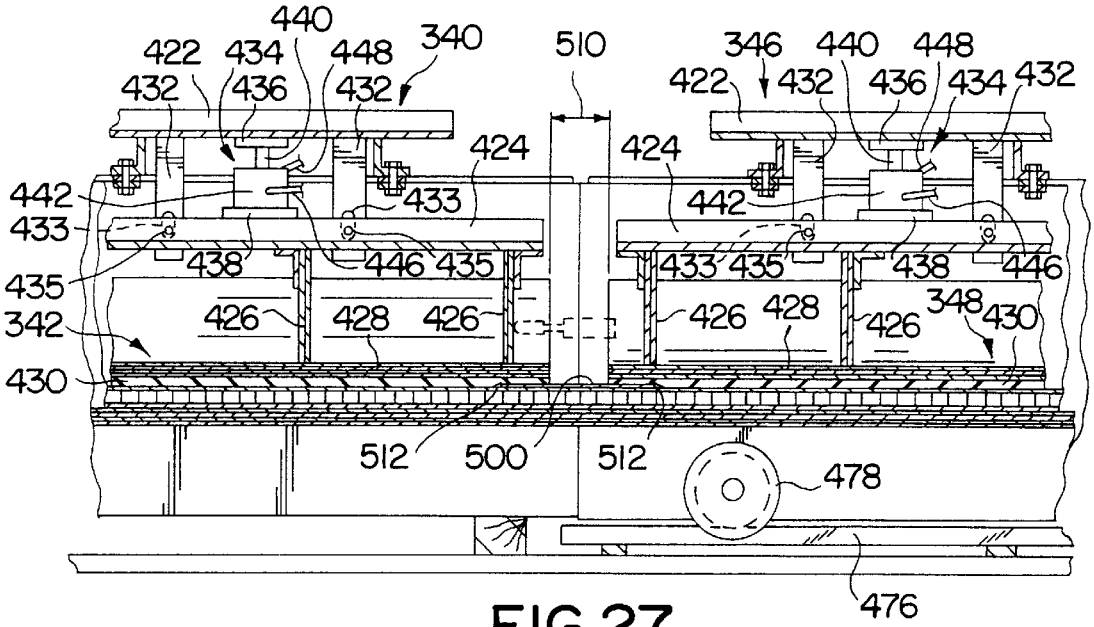
FIG. 27 is a sectional view similar to FIG. 23 showing the spanning plate spanning the gap between the first and second press heads.

Trusses 340, 346 each include a cross member 422 coupled to and extending between respective transverse members 392 in parallel relation with respective longitudinal members 400 as shown in FIGS. 21 and 22. Press heads 342, 348 each include a longitudinal central member 424, a plurality of vertical plates 426 coupled to member 424, an arcuate substrate 428 coupled to vertical plates 426, and a rubber pad 430 coupled to substrate 428 as shown, for example, in FIGS. 22, 23 and 27. Rubber pad 430 provides press heads 342, 348 with convex surfaces 352, 356. Trusses 340, 346 each include a set of flanges 432 coupled to and extending downwardly from respective cross members 422 as shown best in FIG. 23. Flanges 432 are each formed to include a slot 433 and central members 424 are coupled to the respective set of flanges 432 by pins 435 that are received in respective slots 433 as shown in FIGS. 23 and 27. As press heads 342, 348 move relative to respective trusses 340, 346, pins 435 move within slots 433.

Fixture 330 includes a pair of actuators 434 one of which is coupled to cross member 422 of truss 340 and the other of which is coupled to cross member 422 of truss 346 as shown in FIGS. 21–23. When trusses 340, 346 are moved to the lowered positions, press heads 342, 348 are each in respective press positions having convex surfaces 352, 356 engaging respective elements 376 to press elements 172, 376 and cores 360 together with a first amount of force. Each actuator 434 is actuatable to move respective press heads 342, 348 from the press position to a heavy-press position having convex surfaces 352, 356 engaging respective elements 376 to press elements 172, 376 and cores 360 together with a second amount of force greater than the first amount of force. Increasing the force with which elements 172, 376 and cores 360 are pressed together by actuating actuators 434 further enhances the uniformity with which the films of adhesive between elements 172, 376 and cores 360 adhere elements 172, 376 and cores 360 together.

In preferred embodiments, actuators 434 are pneumatic piston-cylinder assemblies hereinafter referred to as assemblies 434. A first spacer plate 436 is mounted to respective members 422 of trusses 340, 346 and a second spacer plate 438 is mounted to respective members 424 of each press head 342, 348 as shown best in FIG. 23. Assemblies 434 each include a cylinder 442, a piston (not shown) situated inside cylinder 442, and a piston rod 440 extending from the piston out of cylinder 442. Piston rods 440 couple to respective plates 436 and cylinders 442 are moveable relative to respective pistons and piston rods 440 between actuated and unactuated positions. When cylinders 442 are in the unactuated positions, cylinders 442 are adjacent to respective plates 436 and are spaced apart from plates 438 as shown in FIG. 23 with reference to first lid-half press 334. As cylinders 442 move from the unactuated positions to the actuated positions, cylinders 442 move away from plates 436 into engagement with plates 438 to move press heads by a distance 444 from the respective press positions to the respective heavy-press positions as shown in FIG. 23 with reference to second lid-half press 336.

Cylinders 442 are moved relative to the respective pistons and pistons rods 440 by pressurized air which is introduced into an interior region (not shown) of respective cylinders 442 through either a respective first hose 446 or a respective second hose 448. When pressurized air is introduced into the interior region of cylinders 442 through first hoses 446, cylinders 442 move from the unactuated positions to the actuated positions and when pressurized air is introduced into the interior region of cylinders 442 through second hoses 448, cylinders 442 move from the actuated positions to the unactuated positions. Assemblies 434 include mechanisms (not shown) that bias cylinders 442 into the unactuated positions when no pressurized air is introduced into the interior region of cylinders 442 through either of hoses 446, 448.

Fixture 330 includes a pair of pressurized air routers 450, each of which are mounted to respective side walls 349 of bases 338, 344 as shown in FIGS. 18–21. Each air router 450 includes a manifold block 452 to which respective hoses 446, 448 couple. In addition, each air router 450 includes a tube connector 454 adapted to couple with a hose (not shown) that delivers pressurized air from an air source (not shown) to air router 450. Each air router 450 further includes a control handle 456 that is moveable to determine whether pressurized air is routed through internal passages (not shown) of manifold block 452 from tube connector 454 to the respective first hose 446 or to the respective second hose 448. Thus, control handles 456 are moveable to move cylinders 442 between the actuated and unactuated positions.

Fixture 330 further includes four anti-warping struts 460, two of which are coupled to truss 340 as shown in FIG. 22 with reference to first lid-half press 334 and two of which are coupled to truss 336 as shown in FIG. 22 (in phantom) with reference to second lid-half press 336. Each anti-warping strut 460 includes spaced-apart lid-engaging ends 462 which, in preferred embodiments, are arcuate. Anti-warping struts 460 are each coupled to respective members 392 of trusses 340, 346 for pivoting movement about a respective pivot axis 464 between a first position in which ends 462 are spaced apart from element 376 of respective covers 58, 64, as shown in FIG. 22 with reference to first lid-half press 334, and a second position in which ends 462 engage flaps 386 of respective elements 376, as shown in FIG. 22 (in phantom) with reference to second lid-half press 336. Engagement of ends 462 of anti-warping struts 460 with flaps 386 of elements 376 presses flaps 386, side rails 180, and elements 172 together tightly between struts 460 and respective concave surfaces 350, 354 of bases 338, 344 which prevents the portion of covers 58, 64 adjacent to side edges 98, 100 thereof from warping away from concave surfaces 350, 354 when press heads 342, 348 are in the press positions and heavy-press positions.

Anti-warping struts 460 are positioned to lie beneath members 392 of respective trusses 340; 346 and above respective press heads 342, 348 as shown in FIG. 23. Fixture 330 includes two springs 466, each of which includes one end coupled to a respective anti-warping strut 460 and another end coupled to a respective flange 432. When struts 460 are in the respective second positions, the associated springs 466 bias struts 460 about respective pivot axes 464 toward the first position. When struts 460 are in the respective first positions, springs 466 bias struts 460 into contact with the flange 432 to which the associated spring is coupled as shown in FIG. 22 with reference to first lid-half press 334. Thus, springs 466 prevent struts 460 from inadvertently pivoting about respective pivot axes 464 during movement of trusses 340, 346 between the raised and lowered positions.

After press heads 342, 348 are moved to the heavy-press positions by actuation of assemblies 434 with control handles 456 and after struts 460 are moved to the second position engaging flaps 386 of elements 376, press heads 342, 348 are left in the heavy-press positions and struts 460 are left in the second positions for a period of time allowing the layers of adhesive between elements 172, 376 and cores 360 to partially cure under pressure. In addition, clamps 388 are each left in the respective clamping positions for a period of time allowing the layers of adhesive between end caps 60, 62, 66, 68 and covers 58, 64 to partially cure under pressure.

In some casket lid embodiments, a light-blocker strip 458, shown best in FIG. 20, is attached to arcuate lower band 152 of perimetral rim 140 of end cap 68 during the time period that the adhesive is curing. About half of light-blocker strip 458 is attached to end cap 68 and about half of light-blocker strip 458 extends longitudinally beyond end panel 136 of end cap 68 as shown in FIGS. 2, 21, 25, and 37. When lid halves 46, 47 are in the closed positions relative to casket shell 42, as shown in FIG. 1, the portion of light-blocker strip 458 extending longitudinally beyond end panel 136 of end cap 68 is positioned to lie adjacent to band 152 of perimetral rim 140 of end cap 62. Thus, light-blocker strip 458 is configured to bridge any gap that exists between end caps 62, 68 to prevent light from reaching interior region 54 of casket shell 42 through the gap between end caps 62, 68. In preferred embodiments, casket 40 does not include light-blocker strip 458 because lid halves 46, 47 are mounted on casket shell 42 so that only a negligible gap exists between end caps 62, 68.

Figure 24:
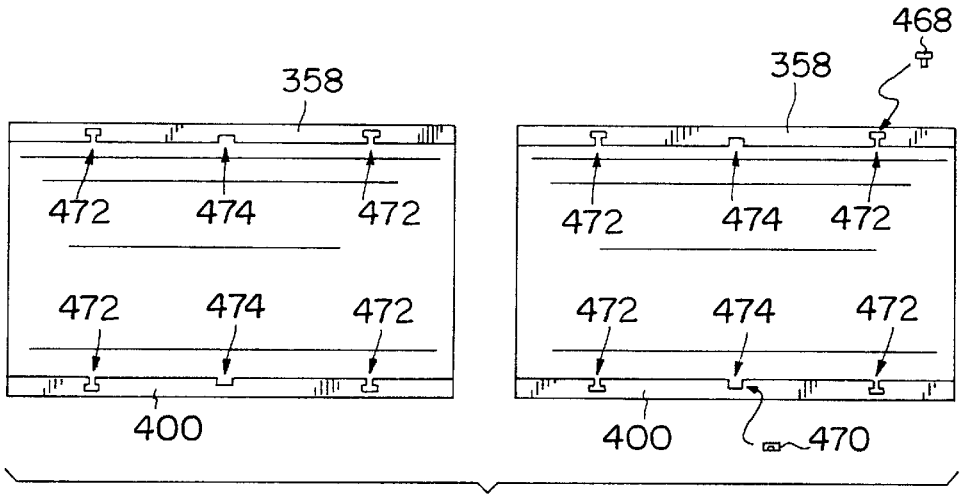

During the time period that the adhesive between elements 172, 376 and cores 360 and between end caps 60, 62, 66, 68 and covers 58, 64 is curing under pressure to form lid halves 46, 47, hinge halves 468 and latch halves 470 are attached to respective lid halves 46, 47 as shown diagrammatically in FIG. 24. Overhanging rails 358 and longitudinal members 400 are each formed to include a pair of hinge cut-outs 472 and a latch cut-out 474 which is positioned to lie between respective hinge cut-outs 472. Thus, rails 358 and members 400 provide fixture 330 with a set of templates that establish the proper placement of hinge halves 468 and latch halves 470 on respective lid halves 46, 47. In preferred embodiments, hinge halves 468 and latch halves 470 are attached to lid halves 46, 47 with screws that are driven through respective edge flaps 176 into the associated side rails 180. However, it is within the scope of the invention as presently perceived for hinge halves 468 and latch halves 470 to be attached to lid halves 46, 47 by other methods such as nailing, gluing, welding, clamping, etc.

Figure 25:
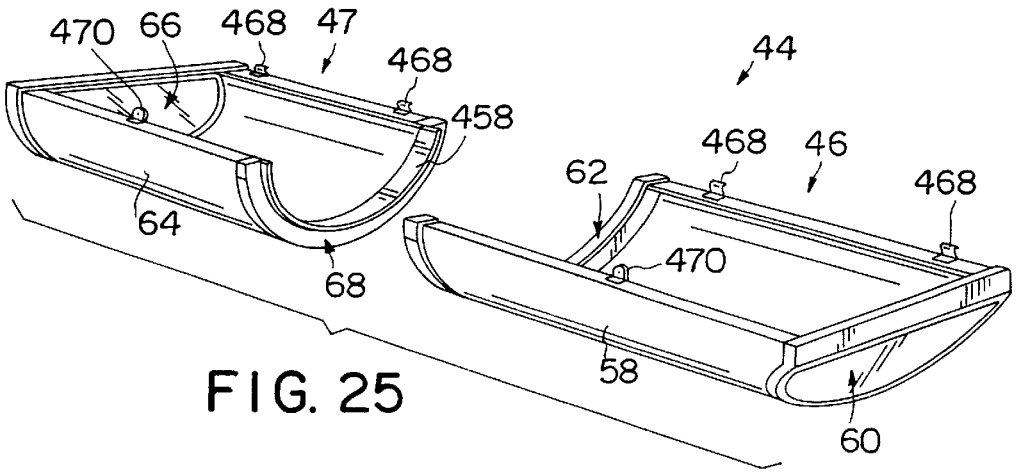
FIG. 25 is a perspective view of the lid halves after removal from the lid-press fixture, before insertion of decorative liners therein, and before attachment to the casket shell of the casket.

After hinge halves 468 and latch halves 470 are attached to lid halves 46, 47 and after the adhesive between elements 172, 376 and cores 360 and between end caps 60, 62, 66, 68 and covers 58, 64 has partially cured under pressure; all clamps 388 are moved to the respective releasing positions; all struts 460 are moved to the respective first positions; both control handles 456 are manipulated to move cylinders 442 to the unactuated positions so that press heads 342, 348 are moved from the heavy-press positions to the press positions; latches 410 are uncoupled from hooks 412; and trusses 340, 346 are moved to the raised positions so that press heads 342, 348 are moved away from lid halves 46, 47 allowing lid halves 46, 47 to be removed from bases 338, 344 of fixture 330. After removal from fixture 330, lid halves 46, 47 are ready for attachment to casket shell 42 as shown in FIG. 25.

Figure 26:
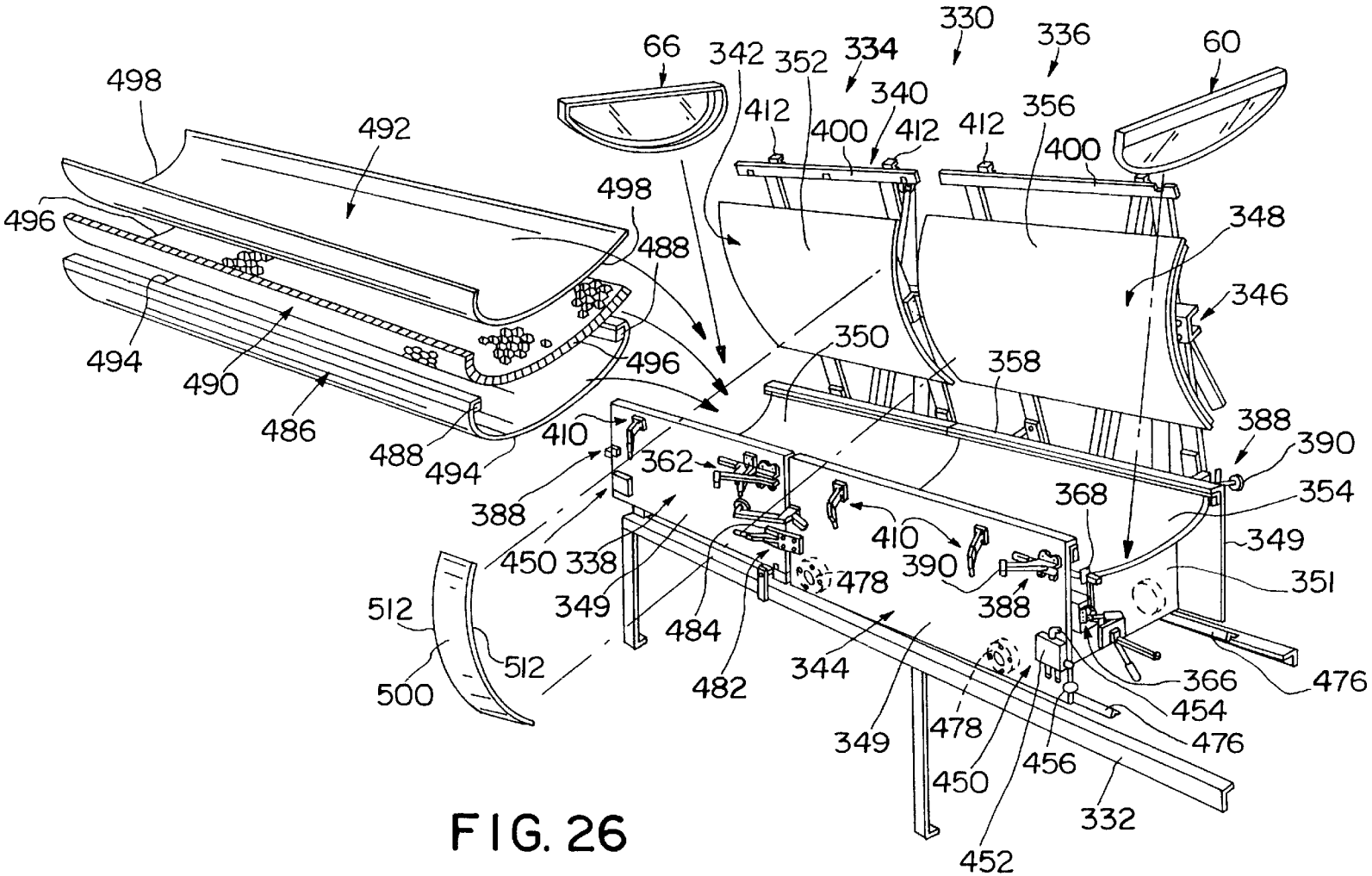
FIG. 26 is a perspective view of the lid-press fixture of FIG. 18 showing the second lid press moved to a second position adjacent to the first lid press allowing a full-length casket lid to be constructed with the lid-press fixture, three full-length casket lid elements exploded away from the concave surfaces of the first and second lid presses, a pair of end caps exploded away from outer ends of the first and second lid presses, and a spanning plate exploded away from the convex surfaces of the first and second press heads and aligned with a gap between the first and second press heads.

Frame 332 of fixture 330 includes a pair of transversely spaced-apart roller tracks 476 as shown in FIGS. 18–21 and 26. Fixture 330 includes a set of rollers 478 mounted for rotation to base 344 of second lid-half press 336 as shown, for example, in FIG. 26 (in phantom). Rollers 478 roll upon roller tracks 476, thereby allowing second lid-half press 336 to move between a first position spaced apart from first lid-half press 334 as shown in FIGS. 18–21, and a second position adjacent to first lid-half press 334 as shown in FIG. 26. When press 336 is in the first position, fixture 330 is used to construct lid halves 46, 47 as previously described and when press 336 is in the second position, fixture 330 is used to construct a full-length casket lid 480, shown in FIG. 28. In preferred embodiments, roller tracks 476 have a V-shaped cross section and each roller 478 is formed to include a V-shaped groove. Receipt of V-shaped tracks 476 in the V-shaped grooves of roller 478 minimizes lateral shifting of press 336 relative to frame 332 as press 336 is moved between the first and second positions.

Fixture 330 includes a pair of coupling latches 482, each of which are mounted to respective side walls 349 of base 344. Fixture 330 further includes a pair of coupling hooks 484, each of which are mounted to respective side walls 349 of base 338. When press 336 is in the second position adjacent to press 334, latches 482 are manipulated to engage respective hooks 484 to lock press 336 in the second position relative to press 334 as shown in FIG. 26. Thus, latches 482 cooperate with hooks 484 to provide fixture 330 with a pair of latch assemblies having a portion mounted to press 334 and a portion mounted to press 336.

Full-length casket lid 480 includes an outer surface element 486 having a cover portion 488 and a pair of edge flaps 490 appended to cover portion 488 as shown in FIG. 26. Lid 480 further includes a pair of side rails 488 that are coupled to element 486 in a manner substantially similar to the manner in which side rails 180 are coupled to elements 172 of lid halves 46, 47. In addition, lid 480 includes a honeycomb core 490 and an inner surface element 492. During construction of lid 480, elements 486, 492 and core 490 are stacked on concave surfaces 350, 354 of bases 338, 344 and adhesive is applied to element 486 and core 490 in a manner similar to the manner in which elements 172, 376 and cores 360 are stacked on surfaces 350, 354 of bases 338, 344 and the manner in which adhesive is applied to elements 172 and cores 360 during construction of lid halves 46, 47. However, as elements 486, 492 and core 490 are stacked on bases 338, 344 only second positioning clamp 366 is moved to the extended position so that second positioning plate 368 facilitates stacking of elements 486, 492 and core 490. Positioning clamp 366 ensures that end edges 494 of element 486, end edges 496 of core 490, and end edges 498 of element 492 are aligned with one another after elements 486, 492 and core 490 are stacked on bases 338, 344.

After elements 486, 492 and cores 490 are stacked on bases 338, 344 but before trusses 340, 346 are moved from the raised positions to the lowered positions, a spanning plate 500, shown in FIG. 26, is placed on element 492 at a position about mid-way between edges 498. When press 336 is in the second position adjacent to press 334, press head 342 is spaced apart from press head 348 by a gap or distance 510 as shown in FIG. 27. The width of spanning plate 500 between side edges 512 thereof is larger than distance 510 so that when trusses 340, 346 are moved to the lowered positions each press head 342, 348 overlaps and engages a portion of spanning plate 500 and spanning plate 500 bridges distance 510 between press heads as also shown in FIG. 27. Thus, when trusses 340, 346 are in the lowered positions the portion of elements 486, 492 and core 490 beneath gap 510 are pressed together between spanning plate 500 and surfaces 350, 354 of bases 338, 344 by spanning plate 500.

Although core 490 and element 492 are shown in FIG. 26 as being single contiguous pieces of material between respective end edges 496, 498, it is within the scope of the invention as presently perceived for element 492 to be comprised of two of elements 386 like those used to construct lid halves 46, 47 and for core 492 to be comprised of two of cores 360 like those used to construct lid halves 46, 47. In such an alternative embodiment full-length casket lid, a small gap exists between edges 372, 380 of respective cores 360 and elements 376 and a strip of material (not shown) is adhered to elements 376 to bridge the gap therebetween. During construction of the alternative embodiment full-length casket lid, spanning plate 500 presses the strip of material against elements 376 to enhance the uniformity with which adhesive between the strip of material and elements 376 adheres the strip of material and elements 376 together.

Figure 28:
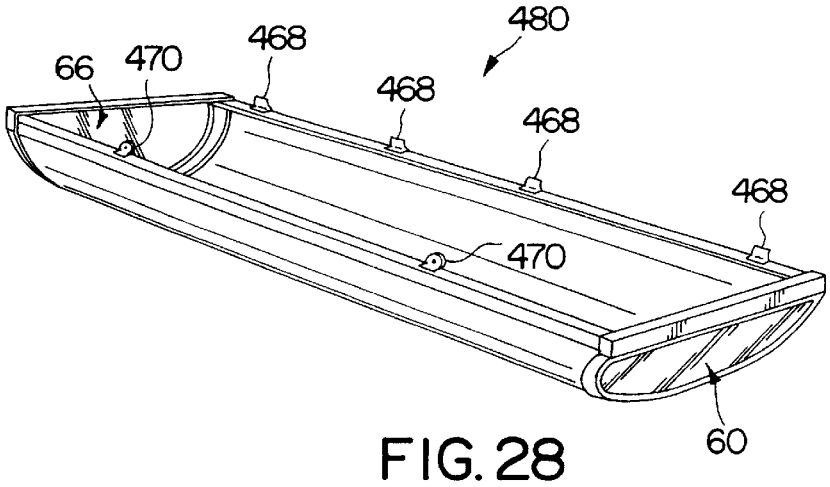
FIG. 28 is a perspective view of the full-length casket lid after removal from the lid-press fixture, before insertion of a decorative liner therein, and before attachment to the casket shell of the casket.

Full-length casket lid 480 includes end caps 60, 66 as shown in FIGS. 26 and 28. During construction of lid 480, end caps 60, 66 are clamped against edges 494, 496, 498 by the appropriate end cap clamps 388 after second positioning clamp 366 is moved to the retracted position and after adhesive is applied to end caps 60, 66. In addition, anti-warping struts 460 are moved to the second positions having lid-engaging ends 462 contacting edge flaps 514 of element 492 and control handles 456 are manipulated to move cylinders 442 to the actuated positions during the construction of lid 480 in substantially the same manner as during construction of lid halves 46, 47. Furthermore, hinge halves 468 and latch halves 470 are attached to lid 480 with the use of cut-outs 472, 474 formed in rails 358 and members 400 in a manner substantially similar to the manner in which hinge halves 468 and latch halves 470 are attached to lid halves 46, 47. After removal from fixture 330, lid 480 is ready for attachment to casket shell 42 as shown in FIG. 28.

Figure 29:
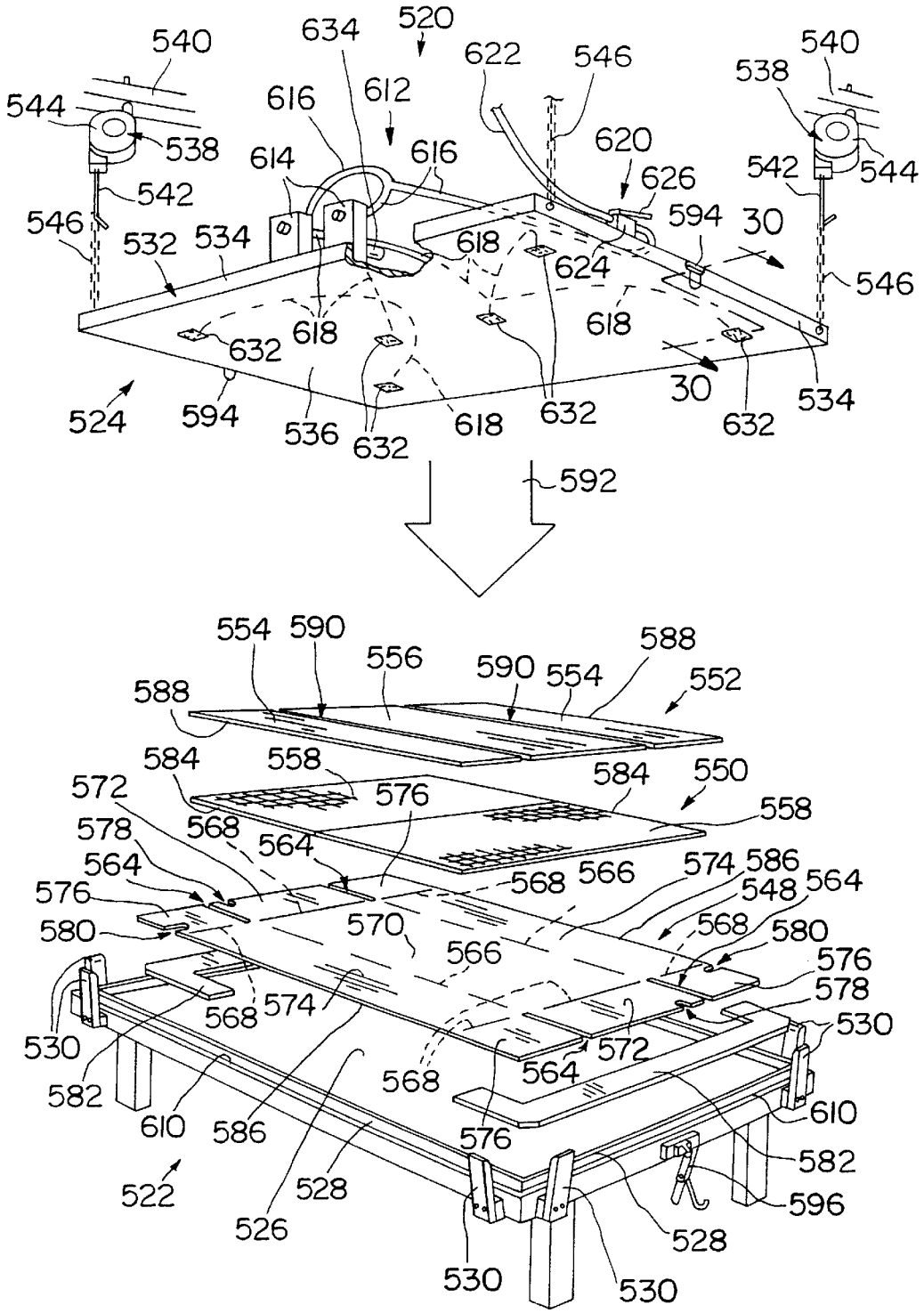
FIGS. 29–35 show a sequence of steps by which the casket shell is made.

Casket 40 includes casket shell 42 having side walls 48 and end walls 50 as previously described. A fixture 520 used during construction of casket shell 42 includes a table 522 and a membrane structure 524 supported for movement relative to table 522 as shown in FIG. 29. Table 522 includes a top surface 526 and a perimetral seal rail 528 extending upwardly from top surface 526. A plurality of frame guides 530 are mounted to table 522 at corner portions thereof. Membrane structure 524 includes a frame 532 having perimetral frame members 534. Membrane structure 524 also includes a flexible membrane 536 attached to frame members 534.

In preferred embodiments, membrane structure 524 is positioned to lie vertically above table 522 and is supported for vertical movement by a set of four counterbalancers 538, two of which are shown in FIG. 29. Counterbalancers 538 are coupled to some type of overlying structure such as, for example, ceiling rafters 540, shown in FIG. 29, or a support frame (not shown). Counterbalancers 538 each include a housing 544 and a cable 542 extending out of the respective housing 544. The ends of each cable 542 are coupled to frame members 534 by respective chains 546 or by other suitable couplers. A lifting mechanism 545 is used to raise and lower fixture 520. Illustratively, lifting mechanism 545 is a pneumatic lift which is centered above fixture 520 and coupled to ceiling rafters 540. Lifting mechanism 545 is illustratively connected to each of the four corners of frame 534 by chains 547. As membrane structure 524 is moved upwardly relative to table 522, cables 542 coil up within respective housings 544 of counterbalancers 538 and as membrane structure 524 is moved downwardly relative to table 522, cables 542 uncoil relative to respective housings 544 of counterbalancers 538 so that, as membrane structure 524 is moved further downwardly, increasing amounts of cables 538 are positioned to lie outside of respective housings 544. Counterbalancers 538 are selected so that when no external force is applied to membrane structure 524 by an operator, membrane structure 524 remains vertically stationary relative to table 522. Counterbalancers 538 can be, for example, commercially available Aero-Motive Ergomation® balancers which are capable of producing about fifty-five to about sixty-five pounds of counterbalancing force.

Casket shell 42 includes an outer surface element 548, a layer of honeycomb core 550, and a set of three inner surface elements 552 as shown in FIG. 29. Inner surface elements 552 include a pair of side sheets 554 and a bottom sheet 556 which is positioned to lie between side sheets 554. In preferred embodiments, each of sheets 554, 556 is made of a paperboard or fiberboard material. Honeycomb core 550 includes two side-by-side core sheets 558, although if manufacturers of honeycomb core material were capable of manufacturing larger sheets, then honeycomb core 550 may be comprised of only a single core sheet. In preferred embodiments, honeycomb core 550 is made of a plurality of strips of paper material fastened together so as to form a plurality of cells, each having a somewhat honeycomb shape. Outer surface element 548 includes a structural sheet 560, preferably made of paperboard or fiberboard material, and a decorative exterior sheet 562 adhered to structural sheet 560 as shown best in FIG. 30. Decorative exterior sheet 562 can be, for example, cloth, vinyl, or a sheet of metal such as aluminum. In addition, decorative exterior sheet 562 can have any of a number of textures and colors.

Outer surface element 548 includes four slots 564, two of which are formed at each end of element 548 as shown in FIG. 29. A pair of longitudinal fold lines or grooves 566 are formed in element 548 as extensions of respective slots 564. In addition, a pair of transverse fold lines or grooves 568 are formed in element 548 and are positioned to lie adjacent to the ends of slots 564. Fold lines 566, 568 cooperate with slots 564 to subdivide element 548 into a center panel 570, a pair of large end flaps 572 appended to center panel 570, a pair of side panels 574 appended to center panel 570, and four small end flaps 576 appended to respective side panels 574 adjacent to respective large end flaps 572 as shown in FIG. 29. Each large end flap 572 is formed to include a notch 578 and two of small end flaps 576 are formed to include a notch 580.

Fixture 520 is used during adherence of elements 548, 552 to core 550. During construction of casket shell 42, element 548 is placed upon surface 526 of table 522. A pair of templates 582 ensure that element 548 is "centered" relative to surface 526 of table 522. Fixture 520 also may be used during construction of an oversize casket shell (not shown) of the type used to bury very large people. When fixture 520 is used during construction of an oversize casket shell, the associated outer surface element (not shown) covers substantially all of surface 526 between seal rails 528 so that templates 582 are not needed. After element 548 is placed upon surface 526 with the assistance of templates 582, a coat or film of adhesive is applied to either element 548 between fold lines 568 or to honeycomb core 550 and then core 550 is placed upon element 548 between fold lines 568. Core 550 is sized so as to substantially cover panels 570, 572 of element 548 when placed upon element 548. Thus, side edges 584 of core 550 are aligned with side edges 586 of element 548 when core 550 is placed upon element 548.

After core 550 is placed upon element 548, a coat or film of adhesive is applied to either core 550 or to elements 552 and then elements 552 are placed upon core 550. Elements 552 are placed upon core 550 so that outer side edges 588 of side sheets 554 are aligned with side edges 584, 586 of core 550 and element 548, respectively, and so that bottom sheet 556 is centered transversely between side sheets 554. In addition, elements 552 are sized so as to substantially cover core 550 except for the portion of core 550 situated beneath a pair of narrow, longitudinally extending gaps 590 defined between sheet 556 and sheets 554. Elements 552 are configured so that gaps 590 overlie fold lines 566.

Figure 30:
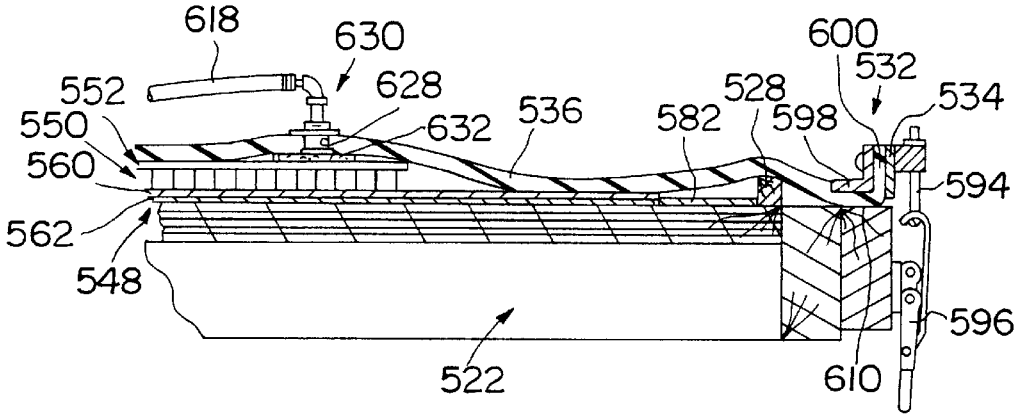

After elements 548, 552 and core 550 are stacked on table 522 with layers of adhesive therebetween, membrane structure 524 is moved in the direction of arrow 592 from a raised position spaced apart from table 522, as shown in FIG. 29, to a lowered position resting upon table 522 as shown partially in FIG. 30. As membrane structure 524 moves from the raised position to the lowered position, frame guides 530 help to guide membrane structure 524 into the lowered position by preventing membrane structure 524 from skewing into an undesirable position relative to table 522 as membrane structure 524 nears table 522. A pair of hooks 594 are coupled to frame members 534 of membrane structure 524 and a pair of latches 596 are coupled to table 522 beneath hooks 594. After membrane structure 594 is moved to the lowered position, latches 596 are manipulated to engage the associated hooks 594, as shown in FIG. 30, to lock membrane structure 594 in the lowered position. Thus, hooks 594 cooperate with latches 596 to provide fixture 520 with a pair of latch assemblies. It is understood that hooks 594 and latches 596 are only optional and may be omitted.

Membrane structure 524 includes flexible membrane 536 and frame 532 having perimetral frame members 534 as previously described. Frame 532 further includes a set of additional frame members 598 having L-shaped cross section as shown in FIG. 30. Each of frame members 598 is coupled to respective frame members 534 so that an upturned, perimetral portion 600 of membrane 536 is squeezed therebetween. In preferred embodiments, frame 532 is made of aluminum and membrane 536 is made of rubber. When membrane structure 524 is locked in the lowered position, the portion of membrane 536 beneath frame members 598 rests upon a table ledge surface 610 which is outside of seal rails 528 and a portion of membrane 536 rests upon seal rails 528 as shown in FIG. 30. In addition, membrane 536 drapes over elements 548, 552 and core 550 of casket shell 42 so that elements 548, 552 and core 550 are pressed together between membrane 536 and surface 526 of table 522 due to the weight of membrane 536.

Fixture 520 includes an air evacuation system 612 coupled to membrane structure 524 as shown best in FIG. 29. Air evacuation system 612 includes a pair of pump units 614 which, in preferred embodiments, are commercially available venturi pumps. Air evacuation system 612 further includes a set of pneumatic supply hoses 616 which couple to first inlets (not shown) of respective pump units 614 and a set of pneumatic suction hoses 618 which couple to second inlets (not shown) of respective pump units 614. System 612 also includes a valve 620 coupled to one of supply hoses 616. In addition, a source of pressurized air (not shown) is coupled to valve 620 via a hose 622. Valve 620 includes a housing 624 and a handle 626 coupled to housing 624. Handle 626 is moveable between a first position in which pressurized air delivered in hose 622 by the source of pressurized air is blocked from reaching hoses 616 and a second position in which the pressurized air delivered by the source of pressurized air flows from hose 622 through passages (not shown) in housing 624 into hoses 616.

Membrane 536 is formed to include a plurality of apertures 628, one of which is shown in FIG. 30, and suction hoses 618 are fluidly coupled to respective apertures 628 by suitable couplers 630. Fixture 520 includes a plurality of porous pads 632 coupled to membrane 536 so as to cover respective apertures 628 as shown in FIGS. 29 and 30. When membrane structure 524 is in the raised position, handle 626 is preferably in the first position blocking the flow of air through housing 624. After membrane structure 524 is moved to the lowered position covering elements 548, 552 and core 550 of casket shell 42, handle 626 is moved to the second position so that pressurized air flows through housing 624 into hoses 616 and then through pump units 614. The pressurized air flowing through hoses 616 and through pump units 614 is discharged to the atmosphere through respective mufflers 634, one of which is shown in FIG. 29.

Pump units 614 employ the venturi effect to create suction on hoses 618 as the pressurized air flows therethrough. The suction produced on hoses 618 by pump units 614 creates suction between membrane 536 and table 522 and thus, air between membrane structure 524 and table 522 is evacuated out from between membrane 536 and table 522. The evacuated air flows through hoses 618, through pump units 614, and is eventually discharged to the atmosphere through mufflers 634 along with the pressurized air. Evacuating air from between membrane 536 and table 522 causes membrane 536 to draw down against elements 548, 552 and core 550 to further compress elements 548, 552 and core 550 together. As membrane 536 draws down against elements 548, 552 and core 550, porous pads 632 keep the portions of membrane 536 that are adjacent to apertures 528 spaced apart from elements 552, as shown in FIG. 30, to prevent these portions of membrane 536 from forming a seal against elements 552 which would degrade the uniformity with which membrane 536 is able to press elements 548, 552 and core 550 against table 522.

Figure 31:
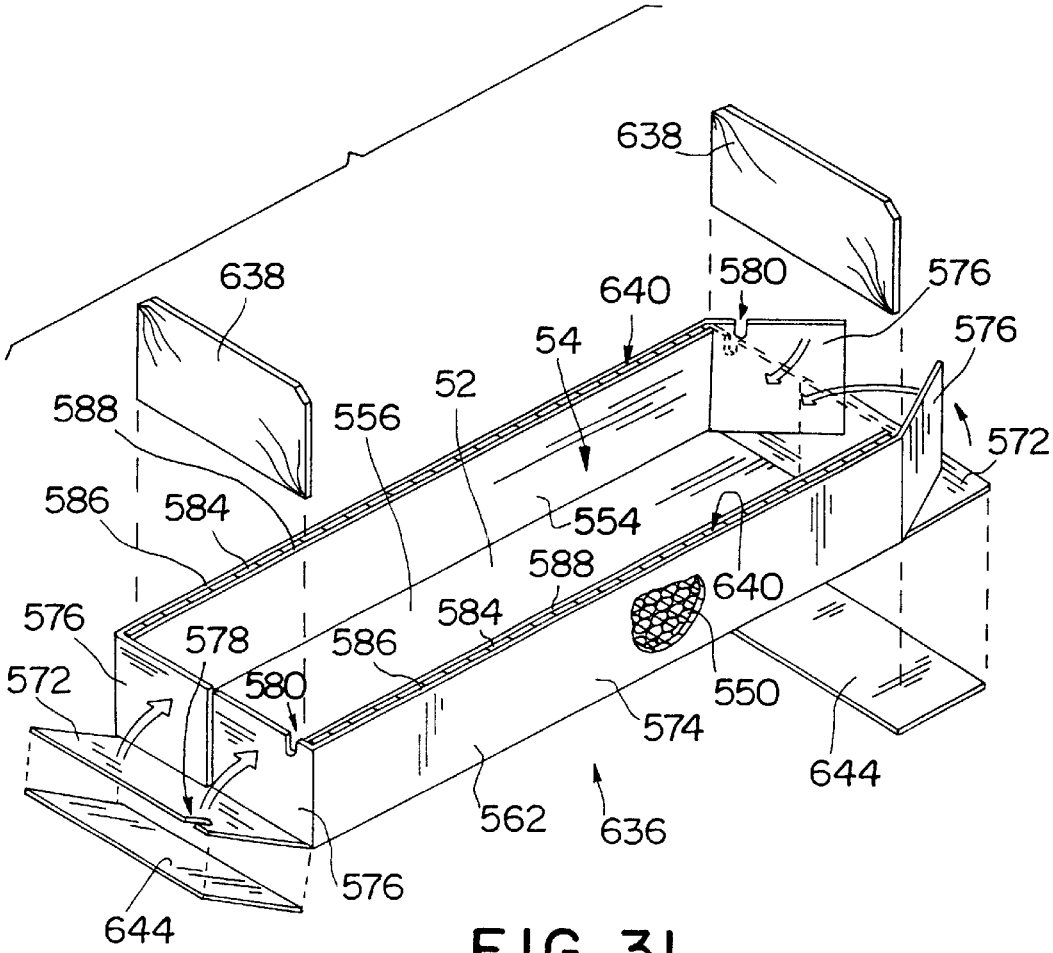

Thus, membrane 536 applies a substantially uniform pressure to elements 548, 552 and core 550 when membrane structure 524 is in the lowered position and handle 626 is moved to the second position. The uniform pressure applied to elements 548, 552 and core 550 enhances the uniformity with which the layers of adhesive between elements 548, 552 and core 550 adheres elements 548, 552 and core 550 together. After handle 626 has been left in the second position for a period of time, handle 626 is moved back to the first position and latches 596 are manipulated to unlock membrane structure 524 from table 522 allowing membrane structure 524 to be moved from the lowered position to the raised position. Elements 548, 552 and core 550 are adhered together to form a casket shell blank 636 which is shown in FIG. 31 in a semi-folded state. Blank 636 is removed from fixture 520 after membrane structure 524 is moved to the raised position. After removal of blank 636 from fixture 520, blank 636 is set aside for a period of time which allows the adhesive between elements 548, 552 and core 550 to cure further. Actuating air evacuation system 612 with handle 626 for about ten to fifteen minutes and allowing the adhesive to cure further for about one hour after blank 636 is removed from fixture 520 have produced suitable results.

Figure 34:
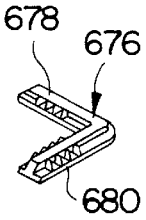

Blank 636 is flat when removed from fixture 520 and is folded into a box-like container as shown in FIGS. 31 and 34. During folding of blank 636, side panels 574 and side sheets 554, along with the portion of core 550 therebetween, are folded upwardly relative to bottom panel 570 and bottom sheet 556 until substantially perpendicular therewith as shown in FIG. 31. Small end flaps 576 are then folded inwardly along vertically oriented portions of fold lines 568 until substantially perpendicular with side panels 574 and side sheets 554. Next, large end flaps 572 are folded upwardly along horizontally oriented portions of fold lines 568 until substantially perpendicular with bottom panel 570 and bottom sheet 556. Casket shell 42 includes a pair of end insert panels 638 which are made of a material stronger than the material from which blank 636 is made. For example, in preferred embodiments, end insert panels 638 are made of plywood.

End insert panels 638 are placed in interior region 54 of blank 636 adjacent to end flaps 576 and then staples are driven though end flaps 572, 576 into end insert panels 638 to secure blank 636 in the box-like configuration. After blank 636 is folded, notches 578 formed in end flaps 572 are aligned with notches 580 formed in end flaps 576. In addition, the upper corners of end insert panels 638 are chamfered so that notches 578, 580 are not covered up by end insert panels 638 after end insert panels 638 are attached to end flaps 572, 576. Both upper corners of end insert panels 638 are chamfered so that, as long as panels 638 are oriented with the chamfered corners up, end panels 638 may be attached to end flaps 572, 576 at either end of blank 636 and facing in either direction.

Thus, after blank 636 is folded, side panels 574 and side sheets 554 cooperate with the portion of core 550 therebetween to comprise side walls 48 of casket shell 42; center panel 570 and bottom sheet 556 cooperate with the portion of core 550 therebetween to comprise bottom wall 52 of casket shell 42; and end flaps 572, 576 cooperate with end insert panels 638 to comprise end walls 50 of casket shell 42. Blank 636 and end insert panels 638 are configured so that, after blank 636 is folded into the box-like configuration and after end insert panels 638 are fastened to blank 636, side walls 48 of casket shell 42 have longitudinal top edges 640 and end walls 50 of casket shell have transverse top edges 642 that are substantially coplanar with top edges 640 as shown best in FIG. 34. The folded blank 636 with end insert panels 638 attached thereto is hereinafter referred to as box 637.

In one preferred embodiment of casket 40, decorative exterior sheet 562 is a vinyl sheet with a grain that "runs" substantially parallel with side edges 586 before blank 636 is folded. After blank 636 is folded, the grain associated with the portions of exterior sheet 562 attached to side panels 574 runs horizontally and the grain associated with portions of exterior sheet 562 attached to end flaps 572 runs vertically. During construction of casket shell 42, a pair of vinyl end decals 644 are adhered to end flaps 572 as shown in FIG. 31. Decals 644 are provided with a grain that runs horizontally after end flaps 572 are folded into overlapping relation with end flaps 576 so that the direction of the grain of the vinyl of end walls 50 matches the direction of the grain of the vinyl of side walls 48. In addition, decals 644 are sized and configured so as not to cover up notches 578, 580 after attachment to end flaps 572.

Although casket shell 42 has been described above as including elements 548, 552 and core 550, it is within the scope of the invention as presently perceived for casket shell 42 to include elements made of materials similar to the materials from which elements 548, 552 and core 550 are made but having different sizes and configurations. For example, casket shell 42 could be made like any of the casket shells shown and described in U.S. patent application Ser. No. 08/589,822 filed Jan. 22, 1996, which is hereby incorporated by reference herein.

Figure 35:
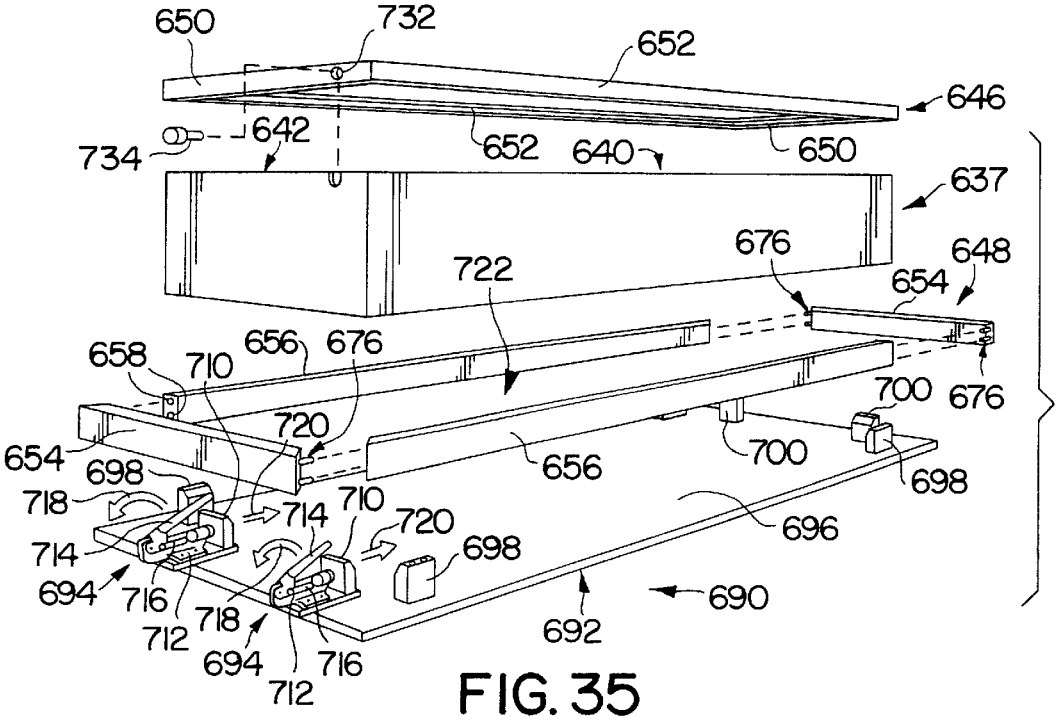

After blank 636 is folded and after end insert panels 638 are coupled to blank 636 to form box 637, an upper perimetral molding frame 646 and a lower perimetral molding frame 648, shown in FIGS. 1, 2, and 35–39 are attached to box 637. Upper perimetral molding frame 646 includes a pair of longitudinally spaced-apart, transverse frame members 650 and a pair of transversely spaced-apart, longitudinal frame members 652 which interconnect transverse frame members 650 as shown in FIG. 35. In addition, lower perimetral molding frame 648 includes a pair of longitudinally spaced-apart, transverse frame members 654 and a pair of transversely spaced-apart, longitudinal frame members 656 which interconnect transverse frame members 654. In preferred embodiments, upper and lower frames 646, 648 are made of medium density fiberboard (MDF), although other materials, such as wood or press board, would also suffice.

The ends of each frame member 650, 652, 654, 656 are beveled or mitered to facilitate coupling of frame members 650 to frame members 652 and to facilitate coupling of frame members 654 to frame members 656. A single hole (not shown) is drilled in each mitered end of frame members 650, 652 and a pair of holes 658, shown in FIG. 35, are drilled in each mitered end of frame members 654, 656 with the use of a drill-guide jig 660 shown in FIGS. 32 and 33. Jig 660 includes a base plate 662 and a center plate 664 extending away from plate 662 in perpendicular relation therewith as shown best in FIG. 33. Jig 660 further includes an end plate 666 which is perpendicular to both of plates 662, 664. Jig 660 also includes four drill bit pass-throughs 668 mounted to end plate 666, two of pass-throughs 668 being positioned to lie on one side of center plate 664 and two being positioned to lie on the other side of center plate 664 as shown in FIG. 33. Each pass-through 668 is formed to include an aperture 670. When a drill bit 672 of appropriate size is received in any one of apertures 670, the drill bit is maintained by the associated pass-through 668 in substantially perpendicular relation with end plate 666 and in substantially parallel relation with both center plate 664 and base plate 662 as shown in FIG. 32.

Figure 32:
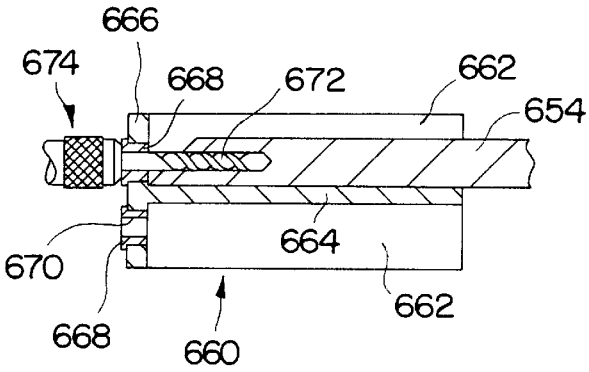
Figure 33:
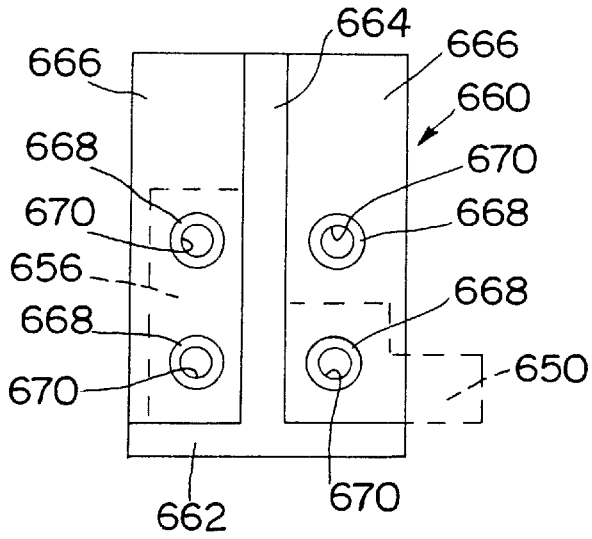

A drill 674, which is shown partially in FIG. 32, is used in conjunction with jig 660 to drill holes in the mitered ends of members 650, 652, 654, 656 at proper locations so that, during construction of upper and lower frames 646, 648, the holes drilled in frame members 650 align with the holes drilled in frame members 652 and so that holes 658 drilled in frame members 654 align with holes 658 drilled in frame members 656. Each frame member 650,652, 654, 656 is placed on jig 660 so as to abut simultaneously each of plates 662, 664, 666 as shown in FIG. 32 with reference to one of frame members 654 and as shown in FIG. 33 (in phantom) with reference to one each of frame members 650, 656. Frame members 652 are placed on jig 660 in a similar fashion. Frame members 650, 652, 654, 656 are placed on jig 660 on either side of center plate 664 depending upon which mitered end of the respective frame member 650, 652, 654, 656 is to be drilled.

A set of L-shaped miter dowels 676, one of which is shown in FIG. 34, are used to couple frame members 650 to frame members 652 and to couple frame members 654 to frame members 656. After the holes are drilled in the mitered ends of frame members 650, 652, 654, 656, each hole receives a first post 678 of a respective miter dowel 676 and a second post 680 of each miter dowel extends away from the mitered end of the respective frame member 650, 652, 654, 656 as shown in FIG. 35. Miter dowels 676 are sized so that a slight press fit exists between frame members 650, 652, 654, 656 and the respective first and second posts 678, 680 of miter dowels 676. Miter dowels 676 can be, for example, commercially available Hafele dowels.

A fixture 690 used during coupling of frame members 650, 652 together to form upper perimetral frame 646 and used during coupling of frame members 654, 656 together to form lower perimetral frame 648 includes a table 692 having an upwardly facing top surface 696 as shown in FIG. 35. Fixture 690 further includes a set of stationary side blocks 698, a pair of stationary end blocks 700, and a pair of moveable block assemblies 694, each of which are coupled to table 692. Block assemblies 694 each include a moveable block 710, a bracket 712, a handle 714 coupled to bracket 712 for pivoting movement, and a push rod 716 coupled to bracket 712 for linear movement. One end of each push rod 716 is coupled to the respective handle 714 and an opposite end of each push rod 716 is coupled to the respective block 710 so that, as handles 714 are pivoted relative to brackets 712, blocks 710 move linearly relative to brackets 712. Handles 714 are each moveable between a first position, shown in FIG. 35, in which blocks 710 are adjacent to brackets 712 and a second position (not shown) in which blocks 710 are moved away from brackets 712 toward end blocks 700.

During construction of lower perimetral frame 648, for example, frame members 656 are placed on top surface 696 of table 692 adjacent to respective side blocks 698, one of frame members 654 is placed on top surface 696 of table 692 adjacent to end blocks 700, and the other of frame members 654 is placed on top surface 696 of table 692 adjacent to moveable blocks 710 while handles 714 are each in the first position. Frame members 654, 656 are placed on table 692 so that posts 680 of miter dowels 676 extend away from frame members 654 toward holes 658 of frame members 656 in parallel relation with top surface 696 of table 692. Posts 680 of miter dowels 676 are aligned with, but spaced-apart from, holes 658 of frame members 656 when frame members 654, 656 are initially placed on table 692 adjacent to associated blocks 698, 700, 710.

Either before or after frame members 654, 656 are placed on table 692, adhesive is applied to selected mitered ends of frame members 654, 656. After the adhesive is applied, each handle 714 is pivoted in a direction 718 resulting in movement of each respective block 710 in a direction 720 as shown in FIG. 35. As each block 710 moves in direction 720, the frame member 654 adjacent to blocks 710 is engaged by blocks 710 and is moved along with blocks 710 in direction 720. Movement of the frame member 654 adjacent to blocks 710 in direction 720 causes posts 680 thereof to enter the associated holes 658 of frame members 656 and causes frame members 656 to move in direction 720 so that the holes 658 aligned with posts 680 extending from the frame member 654 adjacent to blocks 700 are moved toward these posts 680. When handles 714 reach the second position, posts 680 are received filly in respective holes 658 of frame members 656 and the mitered ends of frame members 654 are clamped against the mitered ends of frame members 656. Clamping the mitered ends of frame members 654, 656 together enhances the ability of the adhesive to adhere frame members 654, 656 together. Fixture 690 is operated to clamp frame members 650, against frame members 652 in substantially the same manner that fixture 690 is operated to clamp frame members 654 against frame members 656.

During construction of casket 40, fixture 690 is used to make upper perimetral frame 646 before making lower perimetral frame 648. After upper perimetral frame 646 is removed from fixture 690 and after block assemblies 694 are manipulated to clamp frame members 654 against frame members 656 during construction of lower perimetral frame 648, box 637 is inserted into an opening 722 defined by frame members 654, 656 so that bottom wall 52 of box 637 rests upon top surface 696 of table 692. After box 637 is placed on table 692, a plurality of suitable fasteners (not shown), such as staples or screws, are driven through side walls 48 and end walls 50 into respective frame members 654, 656 so that lower perimetral frame 648 is fastened to box 637.

Figure 37:
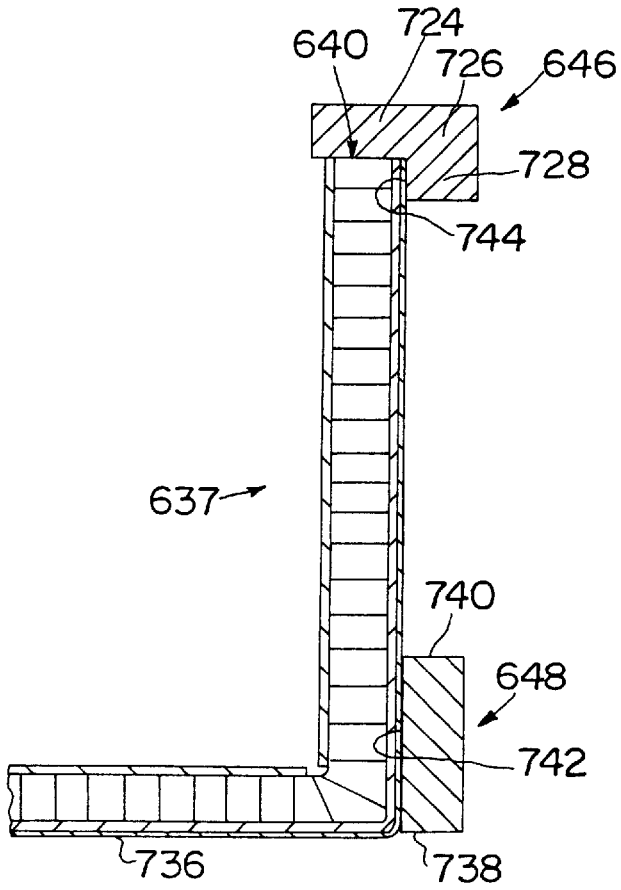
FIG. 37 is sectional view taken along line 37—37 of FIG. 36 showing the manner in which the upper and lower molding frames abut the casket shell.

Frame members 650, 652 of upper perimetral frame 636 each include an edge-covering portion 724, an overhanging portion 726, and a wall-covering portion 728 as shown best in FIG. 37. Thus, frame members 650, 652 have a somewhat L-shaped cross section. Upper perimetral frame 646 is placed on box 637 so that edge-covering portions 724 of frame members 650, 652 rest upon and cover respective top edges 640, 642 of box 637 and so that wall-covering portions 728 of frame members surround and cover respective side and end walls 48, 50 adjacent to top edges 640, 642. After placement of upper perimetral frame 646 on top edges 640, 642 of box 637, suitable fasteners such as staples 730, shown in FIG. 36, are driven through side walls 48 and end walls 50 into wall-covering portions 728 of respective frame members 650, 652 to secure upper perimetral frame 636 to box 637, thereby completing casket shell 42.

Wall-covering portion 728 of one of frame members 650 is formed to include an aperture 732 as shown in FIG. 35. Casket 40 includes a memorial record tube or capsule 734 in which information and identification relating to a deceased person buried in casket 40 is stored. A portion of capsule 734 is received in aperture 732 and a portion of capsule 734 extends away from the associated wall-covering portion 728 beneath the respective edge-covering portion 724. When upper perimetral frame 636 is coupled to box 637, aperture 732 aligns with notches 578, 580 of box 637 so that a portion of capsule 734 is positioned to lie within notches 578, 580. In addition, a portion of capsule 734 overlies the chamfered corner of one of end insert panels 638 as shown in FIG. 36.

Thus, casket shell 42 includes lower perimetral frame 648 that surrounds the lower portion of box 637 and casket shell 42 further includes upper perimetral frame 646 having wall-covering portion 728 that surrounds the upper portion of box 637. Bottom wall 52 of box 637 includes a bottom surface 736 and lower perimetral frame 648 includes a bottom surface 738 that is substantially coplanar with bottom surface 736 as shown in FIG. 37. Lower perimetral frame also includes a top surface 740 spaced apart from bottom surface 738 and an inwardly facing surface 742 extending between bottom and top surfaces 738, 740. Surface 742 of lower perimetral frame 748 abuts side and end walls 48, 50 of box 637 to provide box 637 with added rigidity at the lower portion thereof. In addition, wall-covering portion 728 of upper perimetral frame 646 includes an inwardly facing surface 744 that abuts side and end walls 48, 50 of box 637 to provide box 637 with added rigidity at the upper portion thereof.

Figure 36:
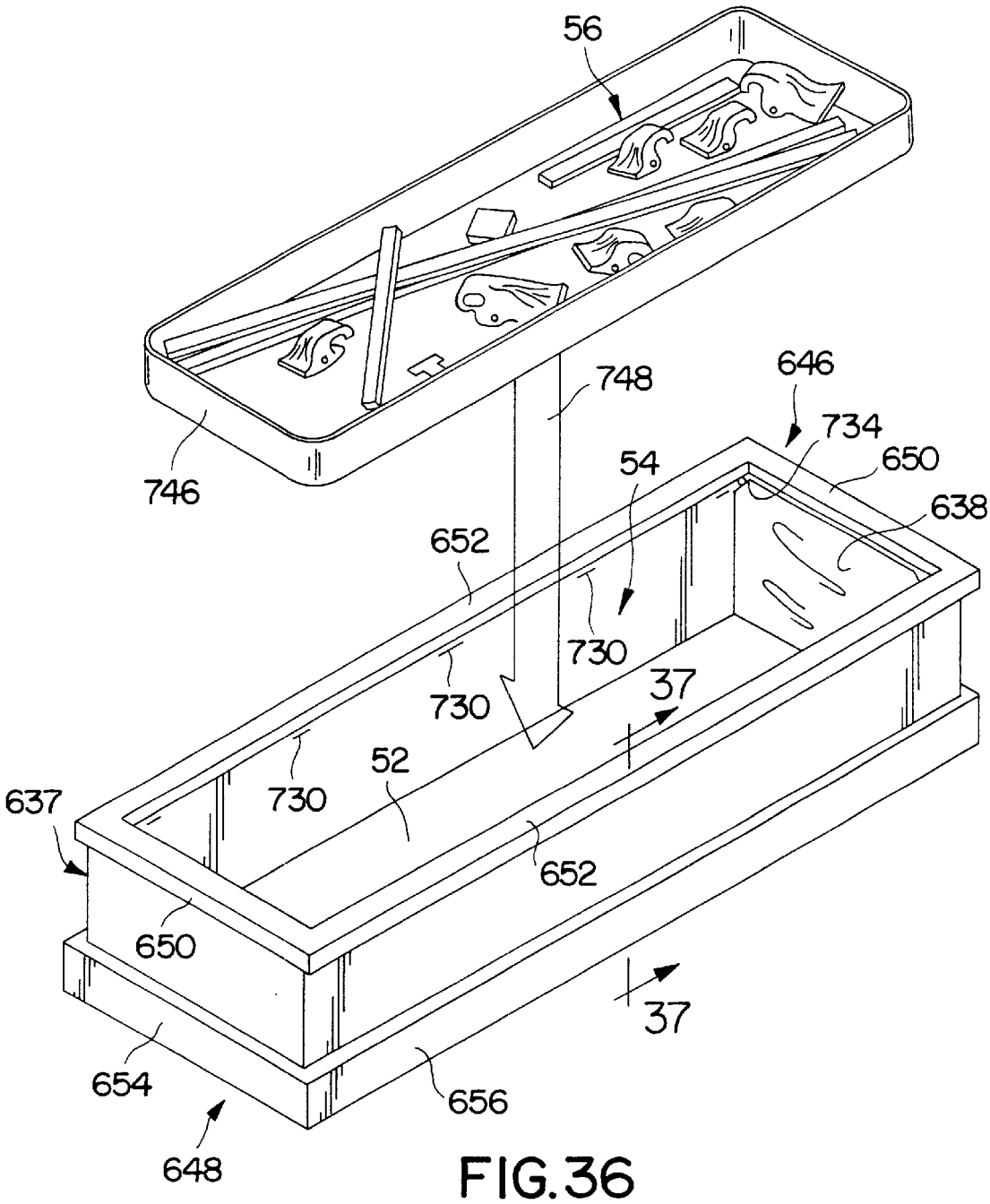
FIG. 36 is a perspective view of the casket shell after the upper and lower molding frames are attached to the box showing a liner containing casket hardware arranged for insertion into the interior region of the casket shell between the end insert panels.

After construction of casket shell 42, a liner 746 is inserted into interior region 54 of casket shell 42 as indicated by arrow 748 of FIG. 36. In a preferred assembly method of casket 40, handle hardware 56 and other hardware pieces, described below in further detail, are loaded into liner 746 before liner 746 is placed into interior region 54 of casket shell 42 so that all of the hardware pieces to be attached to casket shell 42 are readily available to the workers constructing casket 40. In preferred embodiments, liner 746 is made of a liquid impermeable material.

After liner 746 is inserted into interior region 54 of casket shell 42, handle hardware 56 is attached to casket shell 42. Handle hardware 56 includes a pair of longitudinal side handle bars 750, a pair of transverse end handle bars 752, four corner molding pieces 754, and a plurality of handle bosses or ears 756 as shown, for example, in FIG. 38. Ears 756 each include apertures 760 and corner molding pieces 754 each include apertures 762. The ears 756 associated with end walls 50 are attached thereto by screws (not shown) or other suitable fasteners that are received in respective apertures 760 and that are driven through end walls 50 into end insert panels 638. Casket 40 includes a plurality of backing blocks 758 that are positioned to lie in interior region 54 of casket shell 42 adjacent to side walls 48. The ears 756 associated with side walls 48 are attached thereto by screws (not shown) or other suitable fasteners that are received in respective apertures 760 and that are driven through side walls 48 into associated backing blocks 758.

Corner molding pieces 754 each cover portions of side walls 48 and portions of end walls 50. Corner molding pieces 754 are coupled to casket shell 42 by a pair of screws (not shown) or other suitable fasteners that are received by apertures 762 of respective corner molding pieces 754. The screws received by apertures 762 associated with the portions of corner molding pieces 754 that cover end walls 50 are driven through end walls 50 into respective end insert panels 638 and the screws received by apertures 762 associated with the portions of corner molding pieces 754 that cover side walls 48 are driven through side walls 48 into respective backing blocks 758.

Figure 38:
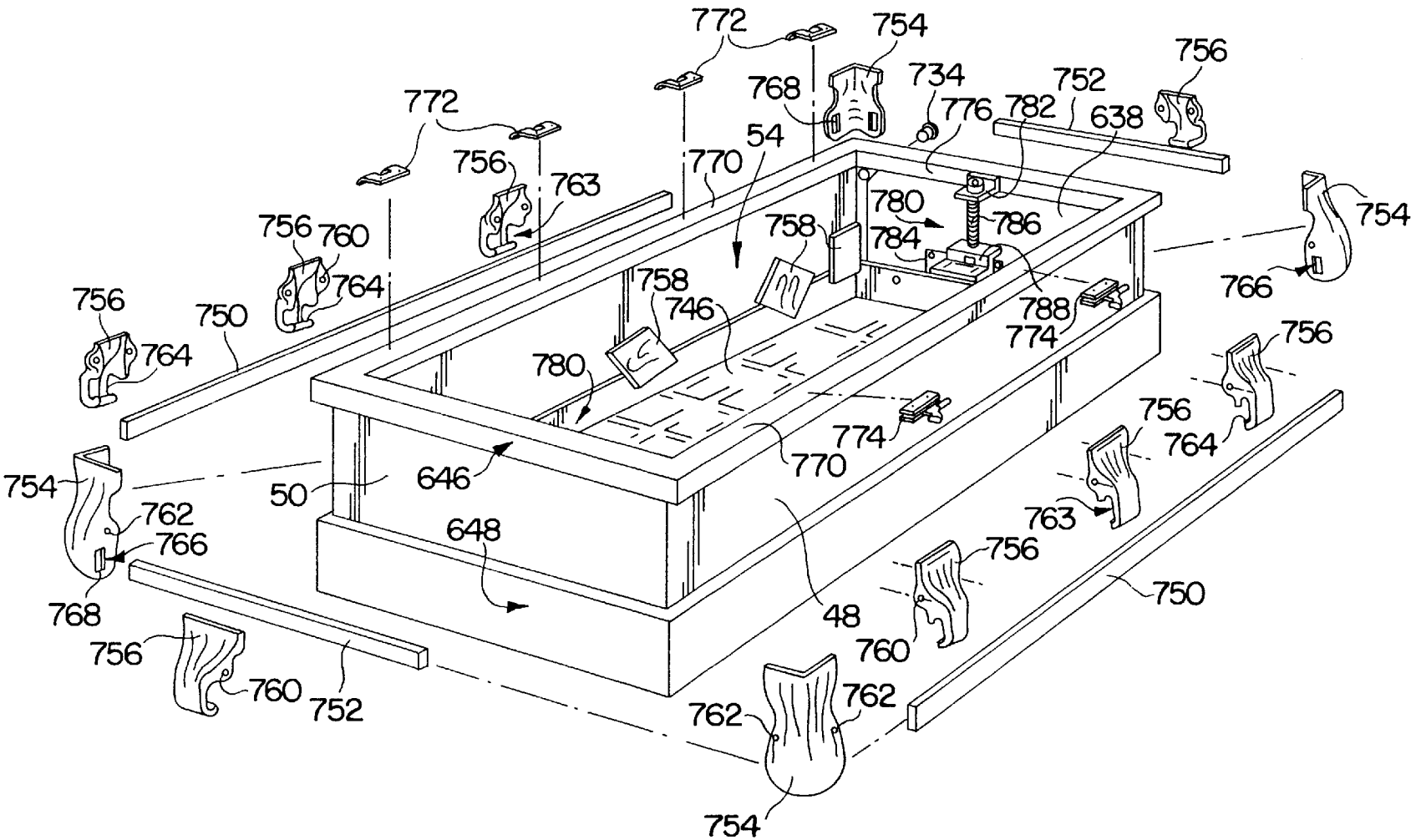
FIG. 38 is a perspective view of the casket shell after the liner is inserted into the interior region of the casket shell showing a plurality of hardware pieces exploded away from the casket shell around interior and exterior surfaces of the casket shell.

Ears 756 each include bar-receiving spaces 763 defined by respective bar-engaging edges 764 and corner molding pieces each include bar-receiving apertures 766 defined by respective bar-engaging edges 768 as shown in FIG. 38. The ends of side handle bars 750 and the ends of end handle bars 752 are received in bar-receiving apertures 766 of respective corner molding pieces 754. In addition, the middle portions of side handle bars 750 and the middle portions of end handle bars 752 are received in bar-receiving spaces 763 of respective ears 756. Side handle bars 750, end handle bars 752, and bar-engaging edges 764, 768 are sized so that only a minimal amount of clearance, if any, exists between bars 750, 752 and edges 764, 768. Thus, edges 764, 768 support bars 750, 752 at a substantially fixed location relative to casket shell 42.

Upper perimetral molding frame 646 includes a top surface 770 to which hinge halves 772 and latch halves 774, shown in FIG. 38, are mounted by suitable fasteners (not shown). In addition, upper perimetral molding frame 646 includes transversely extending, inwardly facing surfaces 776 to which lid braces 252, 254 are mounted by suitable fasteners (not shown). During attachment of hinge halves 772 and latch halves 774 to frame 646, a hardware template (not shown) having cut-outs formed therein is placed upon top surface 770 of frame 646. The cut-outs formed in the hardware template ensure that hinge halves 772 and latch halves 774 are attached to frame 646 at proper locations. In addition, the hardware template includes a pair of drill-guide tabs which are positioned to lie adjacent to surfaces 776 of upper molding frame 646 and which are configured to ensure that holes for receiving the fasteners associated with lid braces 252, 254 are drilled at proper locations.

Figure 39:
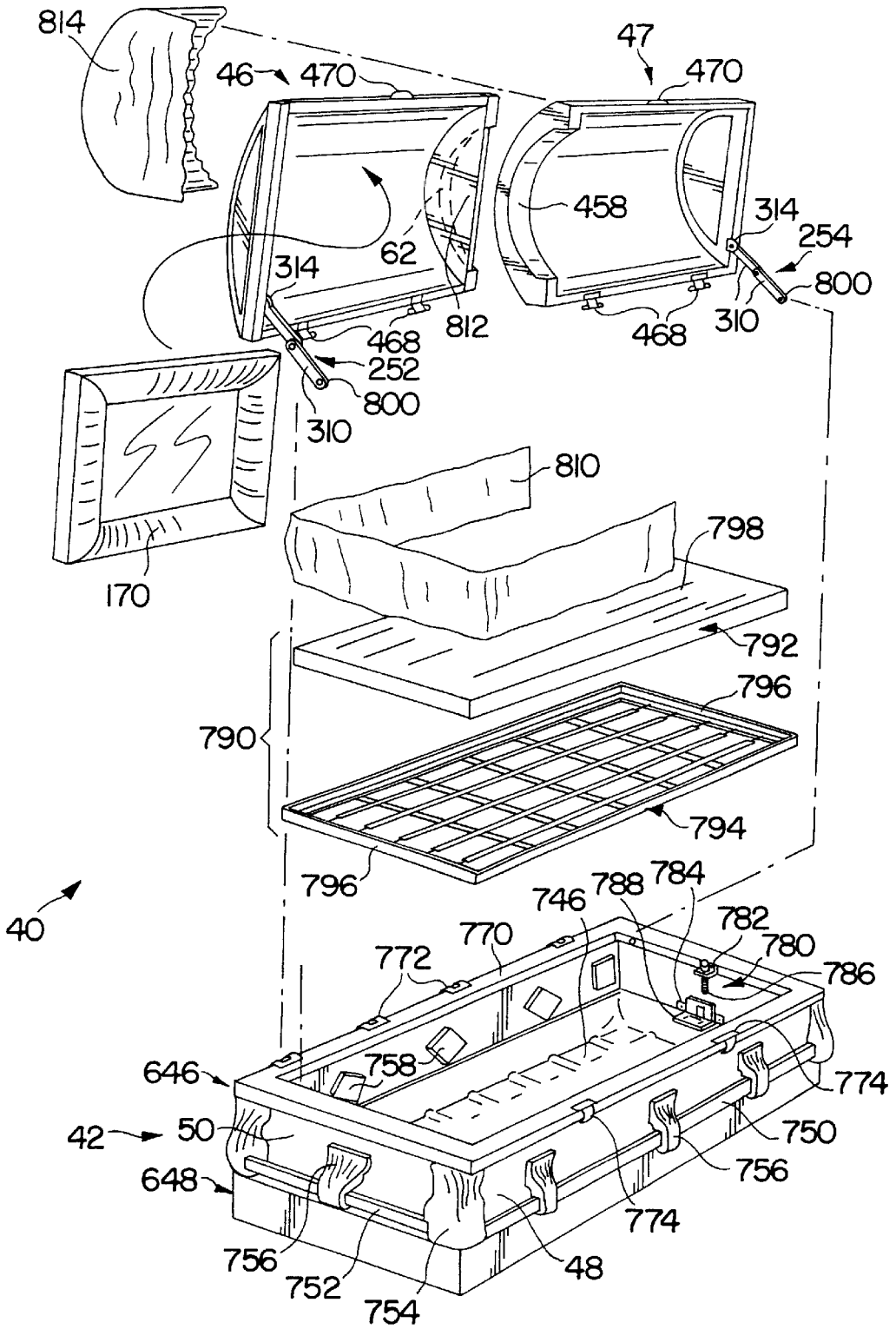
FIG. 39 is an exploded perspective view of the casket after the plurality of hardware pieces are attached to the casket shell showing a mattress frame above the casket shell, a mattress above the mattress frame, the lid halves above the mattress, and various decorative liners that attach to the casket shell and lid halves.

Casket 40 includes a pair of tilting mechanisms 780 that are positioned to lie in interior region 54 of casket shell 42 adjacent to respective end walls 50 as shown in FIGS. 38 and 39. Each tilting mechanism 780 includes an upper bracket 782 coupled to the respective surface 776 of frame 646 and a lower bracket 784 coupled to the respective end insert panel 638 beneath the associated upper bracket 782. Each tilting mechanism 780 further includes a threaded adjustment shaft 786 extending vertically between brackets 782, 784. In addition, each tilting mechanism 780 includes a frame support 788 coupled to the respective shaft 786. Rotation of shafts 786 relative to respective brackets 782, 784 results in vertical adjustment of the associated frame support 788 relative to end walls 50 of casket shell 42.

After handle hardware 56, hinge halves 770, latch halves 774, brace flanges 778, and tilting mechanisms 780 are attached to casket shell 42, as shown in FIG. 38, a body support 790, shown in FIG. 39, is placed in interior region 54 of casket shell 42. Body support 790 includes a mattress 792 and a mattress frame 794. Mattress frame 794 includes transverse end members 796 which couple to frame supports 788 of tilting mechanisms 780. Mattress 792 is supported by frame 794 and includes an upwardly facing body-supporting surface 798 that supports the body of a deceased. Tilting mechanisms 780 are operated to adjust the inclination of mattress 792 within interior region 54 to enhance the position at which the body of the deceased is displayed in casket 40 during burial ceremonies.

After handle hardware 56, hinge halves 770, latch halves 774, brace flanges 778, and tilting mechanisms 780 are attached to casket shell 42, as shown in FIG. 38, lid halves 46, 47 are coupled to casket shell 42. During coupling of lid halves 46, 47 to casket shell 42, hinge halves 468 of lid halves 46, 47 are mated with hinge halves 772 of casket shell 42 and link ends 800 of lid braces 252, 254 are coupled to respective frame members 650 of upper molding frame 646 by suitable fasteners (not shown) which are received in the holes formed in frame 646 with the assistance of the drill-guide tabs of the hardware template as previously described.

Casket 40 includes a decorative shell liner 810 that covers at least a portion of side walls 48 and at least one of end walls 50 in interior region 54 of casket shell 42. One way of displaying the body of a deceased in casket 40 during burial ceremonies is to have lid half 46 in the opened position so that the upper torso and head of the deceased are visible and to have lid half 47 in the closed position as shown in FIG. 2. Thus, the portion of side walls 48 adjacent to the legs of the deceased and end wall 50 adjacent to the feet of the deceased need not be covered by liner 810 because these are not visible during burial ceremonies.

Casket 40 includes lid insert 170 as previously described. Lid insert 170 is coupled to head end lid half 46 after attachment of lid half 46 to casket shell 42. Lid insert 170 includes an end panel 812 adjacent to end cap 62 of lid half 62 as shown in FIG. 39 (panel 812 is separated away from the rest of insert 170 in FIG. 39). If lid half 47 will be left in the closed position during burial ceremonies when the deceased is displayed, then casket 40 need not include a lid insert coupled to lid half 47 but instead, may include a decorative overthrow 814, shown in FIG. 39, that drapes over lid half 47 and covers end cap 68. In other embodiments, a lid insert that is similar to lid insert 170 but without end panel 812 may be coupled to lid half 47. If full-length casket lid 480, shown in FIG. 28, is coupled to casket shell 42, then a full-length lid insert (not shown) is coupled to lid 480.

Although the invention has been described in detail with reference to certain preferred embodiments, variations and modifications exist within the scope and spirit of the invention as described and defined in the following claims.

What is claimed is:

1. A lid for a casket, the lid comprising a cover including longitudinally spaced-apart first and second end edges, transversely spaced-apart first and second side edges, and an arcuate portion extending between the first and second side edges and between the first and second end edges, and an end cap including an end panel having a beveled wall and a rim appended to the end panel, the end cap being coupled to the cover adjacent to the first end edge, the rim extending from the end panel to cover a portion of the cover adjacent to the first end edge, the first end edge includes an arcuate portion adapted to lie in an inclined reference plane that is non-orthogonal and non-parallel with a vertical reference plane extending transversely with respect to the casket. the beveled wall of the end panel being substantially parallel with the inclined reference plane.

2. The lid of claim 1, wherein the end panel includes a perimeter and the rim extends from the perimeter.

3. The lid of claim 2, wherein the rim surrounds the cover adjacent to the first end edge.

4. The lid of claim 2, wherein the end cap is molded from a plastic material.

5. The lid of claim 1, wherein the end cap is formed as a single contiguous piece.

6. The lid of claim 1, further comprising a second end cap including a second end panel and a second rim appended to the second end panel, the second end cap being coupled to the cover adjacent to the second end edge, and the second rim extending from the second end panel to cover a portion of the cover adjacent to the second end edge.

7. The lid of claim 6, wherein the first rim extends from the first end panel in parallel relation with the first and second side edges of the cover and the second rim extends from the second end panel in parallel relation with the first and second side edges of the cover.

8. The lid of claim 6, wherein the first rim extends from the first end panel toward the second end panel and the second rim extends form the second end panel toward the first end panel.

9. The lid of claim 6, wherein the second end edge includes an arcuate portion adapted to lie in a reference plane that extends transversely with respect to the casket, the second end panel includes an arcuate upper perimeter adjacent to the arcuate portion of the second end edge, and the second rim includes an arcuate portion appended to the arcuate upper perimeter of the second end panel.

10. The lid of claim 1, wherein the rim includes an arcuate portion covering a portion of the arcuate portion of the cover.

11. The lid of claim 10, wherein the arcuate portion of the rim includes an inner surface that abuts the arcuate portion of the cover adjacent to the first end edge.

12. The casket of claim 1, wherein the rim abuts the arcuate portion of the cover adjacent to the first end edge and the end panel abuts the first end edge of the cover.

13. A lid for a casket, the lid comprising a cover including longitudinally spaced-apart first and second end edges, transversely spaced-apart first and second side edges, and an arcuate portion extending between the first and second side edges and between the first and second end edges, and an end cap including an end panel and a rim appended to the end panel, the end cap being coupled to the cover adjacent to the first end edge, the rim extending from the end panel to cover a portion of the cover adjacent to the first end edge, wherein the first end edge includes an arcuate portion adapted to lie in an inclined reference plane that is non-orthogonal and non-parallel with a vertical reference plane extending transversely with respect to the casket, the end panel includes a beveled wall with an arcuate upper perimeter adjacent to the arcuate portion of the first end edge, and the rim includes an arcuate portion appended to the arcuate upper perimeter of the beveled wall.

14. A lid for a casket, the lid comprising a cover including longitudinally spaced-apart first and second end edges, transversely spaced-apart first and second side edges, and an arcuate portion extending between the first and second side edges and between the first and second end edges, and an end cap including an end panel and a rim appended to the end panel, the end cap being coupled to the cover adjacent to the first end edge, the rim extending from the end panel to cover a portion of the cover adjacent to the first end edge, wherein the end panel includes a vertical bottom wall and a beveled portion inclined with respect to the bottom wall, the bottom wall including a straight lower perimeter portion and a pair of spaced-apart side perimeter portions, the beveled wall including an arcuate upper perimetral portion, the rim including an arcuate portion appended to the beveled wall and extending longitudinally from the arcuate upper perimeter portion of the beveled wall and a bottom portion appended to the bottom wall and extending longitudinally from the straight lower perimeter portion and the side perimeter portions, the rim surrounding the cover adjacent to the first end edge, and the arcuate portion of the perimetral rim including an inner surface that abuts the arcuate portion of the cover adjacent to the first end edge.

15. A lid for a casket, the lid comprising:

a first end cap including a first end panel having a first perimeter and a first perimetral rim extending away from the first perimeter and having a first beveled wall;

a second end cap including a second end panel having a second perimeter and a second perimetral rim extending away from the second perimeter and having a second beveled wall; and a cover including a first end edge and a second end edge spaced apart from the first end edge, the first perimetral rim surrounding the cover in a region adjacent the first end edge and the second perimetral rim surrounding the cover in a region adjacent the second end edge;

the first and second end edges each including an arcuate portion adapted to lie in an inclined reference plane that is non-orthogonal and non-parallel with a vertical reference plane extending transversely with respect to the casket, the first and second beveled walls of the first and second end panels, respectively, being substantially parallel with the inclined reference planes, respectively.

16. The lid of claim 15, wherein the cover further includes a first side edge extending between the first end edge and the second end edge, a second side edge transversely spaced apart from the first side edge and extending between the first end edge and the second end edge, and an arcuate portion therebetween.

17. The lid of claim 16, wherein the cover further includes a first straight wall extending from the arcuate portion of the cover to the first side edge and a second straight wall extending from the arcuate portion of the cover to the second side edge.

18. A lid for a casket, the lid comprising:

a cover;

an end panel having a beveled wall; and a perimetral rim engaging the cover and engaging the end panel, the perimetral rim being configured to couple the end panel to the cover;

the cover including an end edge including an arcuate portion adapted to lie in an inclined reference plane that is non-orthogonal and non-parallel with a vertical reference plane extending transversely with respect to the casket, the beveled wall of the end panel being substantially parallel with the inclined reference plane.

19. The lid of claim 18, wherein the perimetral rim is integral with the end panel.

20. The lid of claim 18, wherein the cover includes an outer surface and the perimetral rim engages the outer surface of the cover.

21. The lid of claim 18, further comprising adhesive positioned between the perimetral rim and the cover to adhere the rim to the cover.

22. The lid of claim 18, wherein the end panel defines a perimeter having an arcuate upper perimeter portion and a straight lower perimeter portion, and the perimetral rim is appended to the perimeter of the end panel.

23. The lid of claim 22, wherein the perimetral rim defines a rim edge spaced apart from the perimeter by a distance that is substantially uniform about the perimeter.

24. The lid of claim 22, wherein the end panel is generally planar and is generally positioned to lie in an inclined reference plane that is non-orthogonal and non-parallel with a vertical reference plane extending transversely with respect to the lid.

25. The lid of claim 18, wherein the end panel includes a beveled wall having a straight lower perimeter portion and an arcuate upper perimeter portion, a vertical wall appended to the straight lower perimeter portion of the beveled wall, the vertical wall having a second straight lower perimeter portion spaced apart from the straight lower perimeter portion of the beveled wall, and a pair of side perimeter portions extending therebetween, the second straight lower perimeter portion cooperating with the pair of side perimeter portions and the arcuate upper perimeter portion to define a perimeter of the first end panel.

26. The lid of claim 25, wherein the perimetral rim is appended to the perimeter of the end panel.

27. The lid of claim 25, wherein the beveled wall is generally planar, the vertical wall is generally planar, and the beveled wall is positioned to lie in an inclined reference plane that is non-orthogonal and non-parallel with a vertical reference plane in which the vertical wall is positioned to lie.

28. The lid of claim 27, wherein the perimetral rim is appended to the perimeter of the first end panel.

* * * * *